US010570893B2

(12) United States Patent
Yasuda et al.

(10) Patent No.: US 10,570,893 B2
(45) Date of Patent: Feb. 25, 2020

(54) HYDRAULIC PUMP AND DETACHABLE SERVO UNIT

(71) Applicant: Kanzaki Kokyukoki Mfg. Co., Ltd., Amagasaki-shi, Hyogo (JP)

(72) Inventors: Toshifumi Yasuda, Amagasaki (JP); Daisuke Murashima, Amagasaki (JP); Takehiro Ota, Amagasaki (JP)

(73) Assignee: KANZAKI KOKYUKOKI MFG. CO., LTD., Amagasaki-shi, Hyogo (JP)

( * ) Notice: Subject to any disclaimer, the term of this patent is extended or adjusted under 35 U.S.C. 154(b) by 272 days.

(21) Appl. No.: 15/165,976

(22) Filed: May 26, 2016

(65) Prior Publication Data

US 2016/0348654 A1 Dec. 1, 2016

(30) Foreign Application Priority Data

May 29, 2015 (JP) ..... 2015-110735
Mar. 2, 2016 (JP) ..... 2016-040534

(51) Int. Cl.
*F04B 1/32* (2006.01)
*F04B 27/22* (2006.01)
*F04B 1/324* (2020.01)

(52) U.S. Cl.
CPC ..... *F04B 1/324* (2013.01); *F04B 27/22* (2013.01)

(58) Field of Classification Search
CPC ..... F04B 1/324; F04B 1/328; F04B 1/322; F04B 1/32; F04B 1/34; F04B 1/30; F04B 1/2078; F04B 27/20; F04B 27/22; F04B 27/24
See application file for complete search history.

(56) References Cited

U.S. PATENT DOCUMENTS 3,250,227 A * 5/1966 Kouns ..... F01B 3/106 417/222.1
4,102,607 A * 7/1978 Benson ..... F04B 1/324 417/222.1
4,494,911 A * 1/1985 Davis ..... F04B 1/324 417/222.1

(Continued)

FOREIGN PATENT DOCUMENTS

CN 202517588 U 11/2012
EP 1375821 A1 1/2004
JP 2015-055180 A 3/2015

OTHER PUBLICATIONS

Extended European Search Report issued in European Patent Application No. 16171703.8, dated Oct. 28, 2016, 7 pages.

(Continued)

*Primary Examiner* — Bryan M Lettman
(74) *Attorney, Agent, or Firm* — Sterne, Kessler, Goldstein & Fox P.L.L.C.

(57) ABSTRACT

A housing of a hydraulic pump is configured to have a servo unit detachably attached thereto so as to control tilt direction and angle of its movable swash plate. A port block is formed therein with a pair of main ports and, and a pair of main fluid passages and fluidly connecting respective main ports and to cylinders in its cylinder block. Main ports are used to have respective external pipes connected thereto so as to fluidly connect the hydraulic pump to a hydraulic motor disposed outside of the hydraulic pump, thereby constituting a hydrostatic transmission.

11 Claims, 19 Drawing Sheets

(56) References Cited

U.S. PATENT DOCUMENTS

RE32,403 E * 4/1987 Bobier ..... F04B 1/20 417/222.1
4,655,689 A * 4/1987 Westveer ..... F04B 1/324 417/222.1
4,896,506 A * 1/1990 Shivvers ..... F16H 39/14 60/487
5,123,815 A * 6/1992 Larkin ..... F04B 49/022 417/218
5,135,362 A * 8/1992 Martin ..... F04B 1/126 417/218
5,311,740 A * 5/1994 Shiba ..... B60K 17/105 60/453
6,068,451 A * 5/2000 Uppal ..... F04B 1/324 417/222.1
6,095,760 A * 8/2000 Houtman ..... F04B 1/324 417/218
6,508,059 B1 * 1/2003 Takada ..... F15B 21/042 60/454
6,889,595 B1 * 5/2005 Trimble ..... F01B 13/04 417/239
7,082,762 B1 * 8/2006 Trimble ..... F04B 1/2064 417/239
7,523,610 B2 * 4/2009 Sakikawa ..... F16D 31/00 60/468
2006/0174614 A1 * 8/2006 Dong ..... F04B 1/324 60/444
2006/0269421 A1 * 11/2006 Sakikawa ..... F04B 1/2021 417/53
2007/0017219 A1 * 1/2007 Niidome ..... F04B 1/324 60/444
2008/0245066 A1 * 10/2008 Mish ..... F04B 1/324 60/487
2014/0140863 A1 * 5/2014 Yasuda ..... F04B 1/2085 417/222.2

OTHER PUBLICATIONS

Second Office Action issued in Chinese Patent Application No. 201610371687.9, dated Apr. 17, 2019, 18 pages.

* cited by examiner

HYDRAULIC PUMP AND DETACHABLE SERVO UNIT

CROSS-REFERENCE TO RELATED APPLICATIONS

The present application claims priority to Japanese Patent Applications No. 2015-110735, filed on May 29, 2015, and No. 2016-040534, filed on Mar. 2, 2016, which are incorporated by reference herein in their entirety.

BACKGROUND

Field of the Invention

The present invention relates to a hydraulic pump adapted for a hydrostatic transmission (hereinafter, referred to as "HST") including a hydraulic motor.

Related Art

As disclosed by JP 2015-055180 A, an HST including a hydraulic pump and a hydraulic motor is well-known as a transmission broadly adaptable to various working vehicles, e.g., a mower tractor. The disclosed HST includes a housing incorporating both the hydraulic pump and the hydraulic motor. In the HST, a servo unit for controlling tilt angle and direction of a movable swash plate of the hydraulic pump is detachably attached to the housing.

The above-mentioned assembly as the HST including the hydraulic pump and motor is advantageous to reduce component parts. For example, the HST does not need pipes interposed between the hydraulic pump and the hydraulic motor.

Further, the servo unit can be detached from the housing so that the HST can be provided with an actuator which does not use an expensive servomechanism to control the tilt angle and direction of the movable swash plate. The actuator is also detachable from the HST so as to be exchangeable for the servo unit.

However, in some cases, a vehicle is desired to have another typed HST in which a hydraulic pump and a hydraulic motor are separated from each other rather than those combined as an assembly. The hydraulic pump separated from the hydraulic motor is minimized advantageously to enhance a freedom in layout thereof. The hydraulic pump separated from the hydraulic motor is also desired to have either the detachable servo unit or the detachable actuator without a servomechanism, so that the servo unit and the actuator are exchangeable for each other.

SUMMARY

An object of the invention is to provide a hydraulic pump, which is advantageous in minimization such as to enhance a freedom in layout thereof, and in standardization such as to optionally have a servo unit.

To achieve the object, an axial piston hydraulic pump according to the invention includes a drive shaft, a housing, a port block, a cylinder block, a plurality of plungers, and a movable swash plate. The drive shaft receives power from a power source. The housing journals the drive shaft. The port block is assembled with the housing. The cylinder block is slidably and rotatably attached to the port block and is disposed in the housing. The plurality of plungers are fitted into respective cylinders formed in the cylinder block so as to reciprocally slide parallel to the drive shaft. The movable swash plate is rotatably supported by the housing and abuts against the plungers. The housing is configured so that a servo unit for adjusting a tilt direction and a tilt angle of the movable swash plate is detachably attachable to the housing. The port block includes a pair of externally open ports which are configured to be fluidly connected via respective external pipes to a hydraulic motor disposed separately from the hydraulic pump. The port block includes a pair of main fluid passages connecting the respective externally open ports to the cylinders in the cylinder block.

Therefore, the axial piston hydraulic pump, to which the servo unit can be detachably attached, can be disposed separately from the hydraulic motor so as to ensure a layout freedom of an HST including the hydraulic pump and motor fluidly connected to each other, whereby the HST is adaptable to vehicles and the like with various designs and sizes. Also, the detachable servo unit can be exchanged easily for a non-servo actuator. In other words, either the servo unit or the non-servo actuator can be selectively attached to the hydraulic pump so as to control delivery direction and amount of the hydraulic pump, thereby promoting standardization of the hydraulic pump for reducing costs.

Preferably, the port block includes a fluid-charge passage for supplying hydraulic fluid to the pair of main fluid passages. The port block is provided with a charge relief valve for regulating a hydraulic pressure in the fluid-charge passage. The charge relief valve is extended from the port block to an inside of the housing.

Therefore, it is advantageous to minimize the hydraulic pump, especially, the port block of the hydraulic pump. In this regard, if the port block made of aluminum or the like had to incorporate the whole charge relief valve, the port block would have to be thick to ensure a sufficient strength so as to increase costs and so as to hinder minimization thereof. On the contrary, the arrangement of the charge relief valve extended from the port block to the inside of the housing is advantageous to reduce a portion of the port block for supporting the charge relief valve, thereby minimizing the port block so as to contribute to minimization of the entire hydraulic pump and to reduction of costs.

Further preferably, the port block has a plane surface to which the cylinder block is attached. The plane surface is perpendicular to the drive shaft. The pair of main fluid passages include parallel portions, which are parallel to each other and to the plane surface. A pair of charge check valves are disposed on the parallel portions of the pair of main fluid passages, respectively. The charge relief valve and the fluid-charge passage are disposed in a portion of the port block between the pair of charge check valves. The pair of charge check valves are extended parallel to the drive shaft.

Therefore, the arrangement of the charge check valves parallel to the plane surface of the port block is advantageous to minimize the port block in which the pair of charge check valves are entirely disposed. On the other hand, as mentioned above, the charge relief valve is extended from the port block to the inside of the housing so as to minimize a portion of the port block incorporating the charge relief valve. As a result, a portion of the charge relief valve in the port block is disposed in a small space between the pair of charge check valves, thereby further ensuring minimization of the port block.

Further preferably, the port block is provided therethrough between one side surface and another side surface thereof opposite each other with the fluid-charge passage crossing the pair of charge check valves. An open end of the fluid-charge passage at the one side surface of the port block serves as a gauge port for receiving hydraulic fluid from an outside of the hydraulic pump. Another open end of the fluid-charge passage at the other side surface of the port block serves as a servo port for supplying hydraulic fluid to the servo unit attached to the housing.

Therefore, the parallel portions of the main fluid passages on which the pair of charge check valves are disposed and the fluid-charge passage extended perpendicular to the pair of charge check valves are compactly formed in the port block by simple boring. The opposite open ends of the fluid-charge passage penetrating the port block between opposite ends of the port block serve as the gauge port and the servo port, thereby reducing manufacturing processes and costs and minimizing the port block, in comparison with a case where different fluid passages are provided with a gauge port and a servo port, respectively.

Preferably, the hydraulic pump includes a pair of supporters by which the movable swash plate is tiltably supported at respective opposite side portions thereof. The servo unit is fixed to one of the supporters. A sensor for detecting a tilt angle of the movable swash plate is fixed to the other of the supporters.

Therefore, the pair of supporters tiltably supporting the opposite side portions of the movable swash plate are used for easy and compact assembling of the servo unit and the sensor with the hydraulic pump.

Preferably, the hydraulic pump is provided with at least one external pump driven by the drive shaft, and is configured so that fluid delivered from the at least one external pump is supplied to the servo unit. A filter is assembled with the hydraulic pump so as to filter the fluid delivered from the external pump before the fluid enters the servo unit.

Therefore, due to the hydraulic pump provided with the at least one external pump and the filter, no additional space for attaching an external pump and a filter to the hydraulic pump is needed. Also, a fluid passage system from the external pump to the servo unit via the filter is simplified advantageously to minimize an apparatus and to reduce costs.

These and other objects, features and advantages of the invention will appear more fully from the following detailed description of the invention with reference to the attached drawings.

DETAILED DESCRIPTION

A hydraulic pump of the present application can serve as a hydraulic pump of an HST that also includes a hydraulic motor. The HST including the hydraulic pump can be equipped on a vehicle with a prime mover (i.e., a power source) such as an internal combustion engine so that the HST transmits power from the prime mover to drive wheels of the vehicle. A mower tractor may serve as a typical vehicle equipped with the HST.

Figure 1:
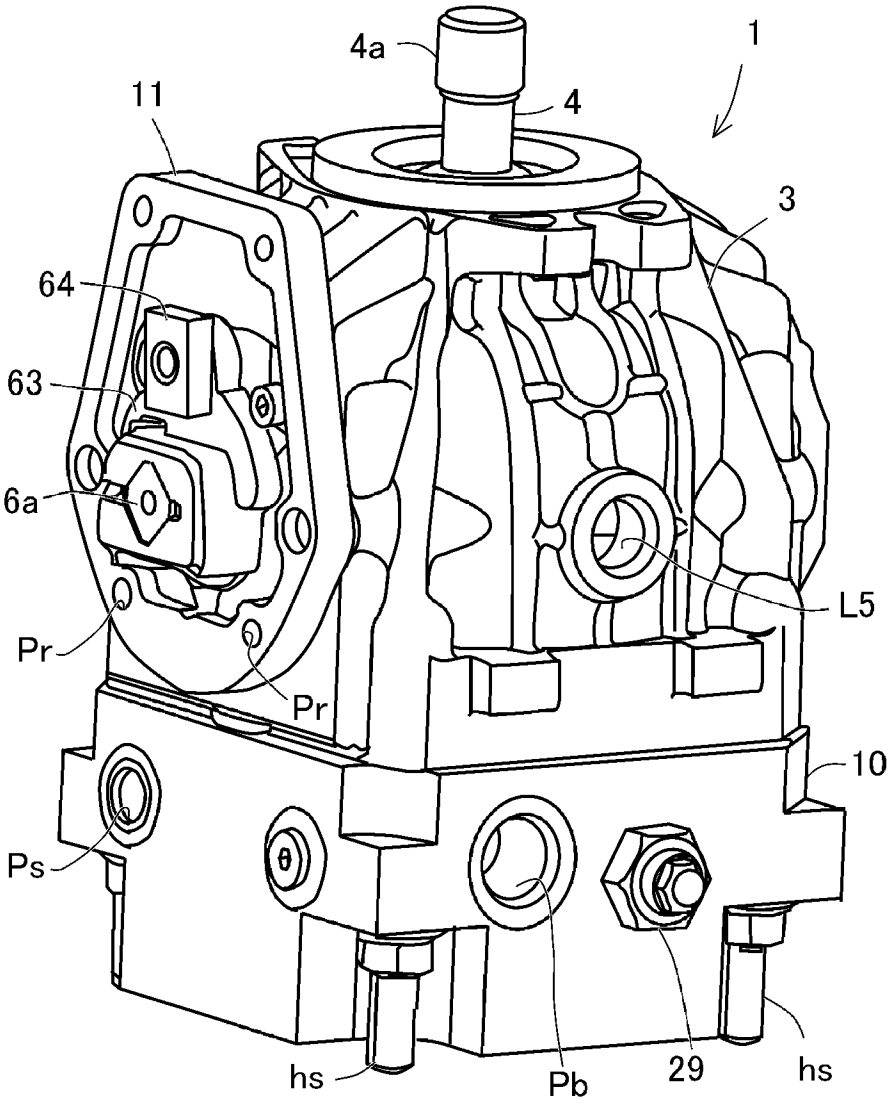
FIG. 1 is a perspective front view of a hydraulic pump and a servo unit when they are separated from each other.
Figure 1:
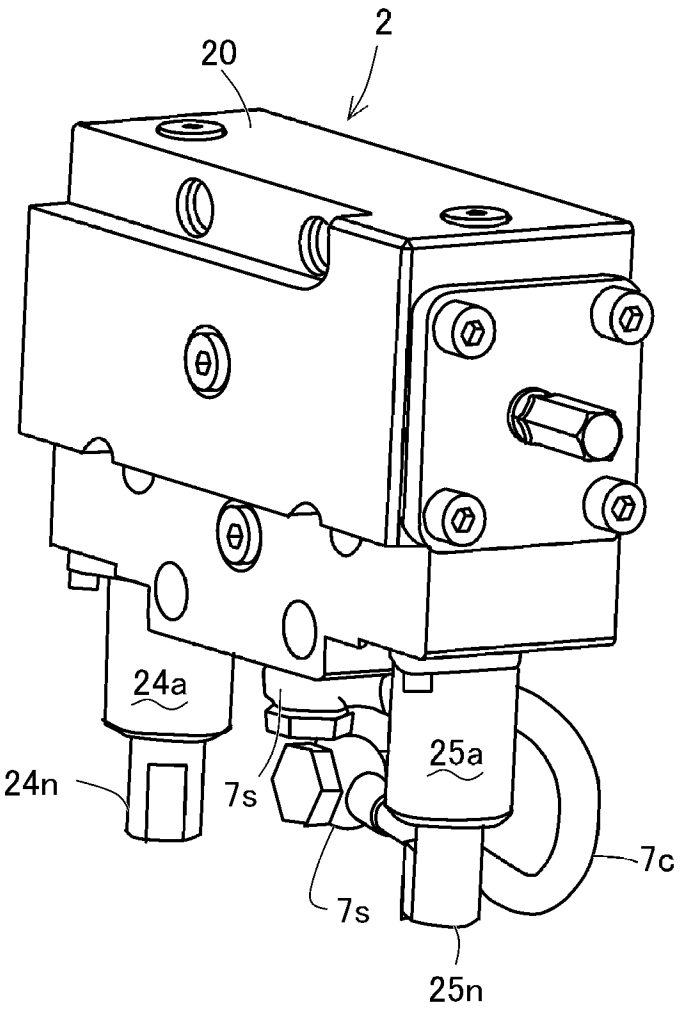

Referring to FIG. 1, a hydraulic pump 1 is a variable displacement axial piston hydraulic pump serving as an embodiment of the present hydraulic pump as mentioned above. A servo unit 2 is detachably attached to hydraulic pump 1. Hydraulic pump 1 includes a movable swash plate 6 whose tilt angle and direction are controlled by servo unit 2 so as to control the variable displacement (i.e., the fluid delivery amount and direction) of hydraulic pump 1.

Figure 3:
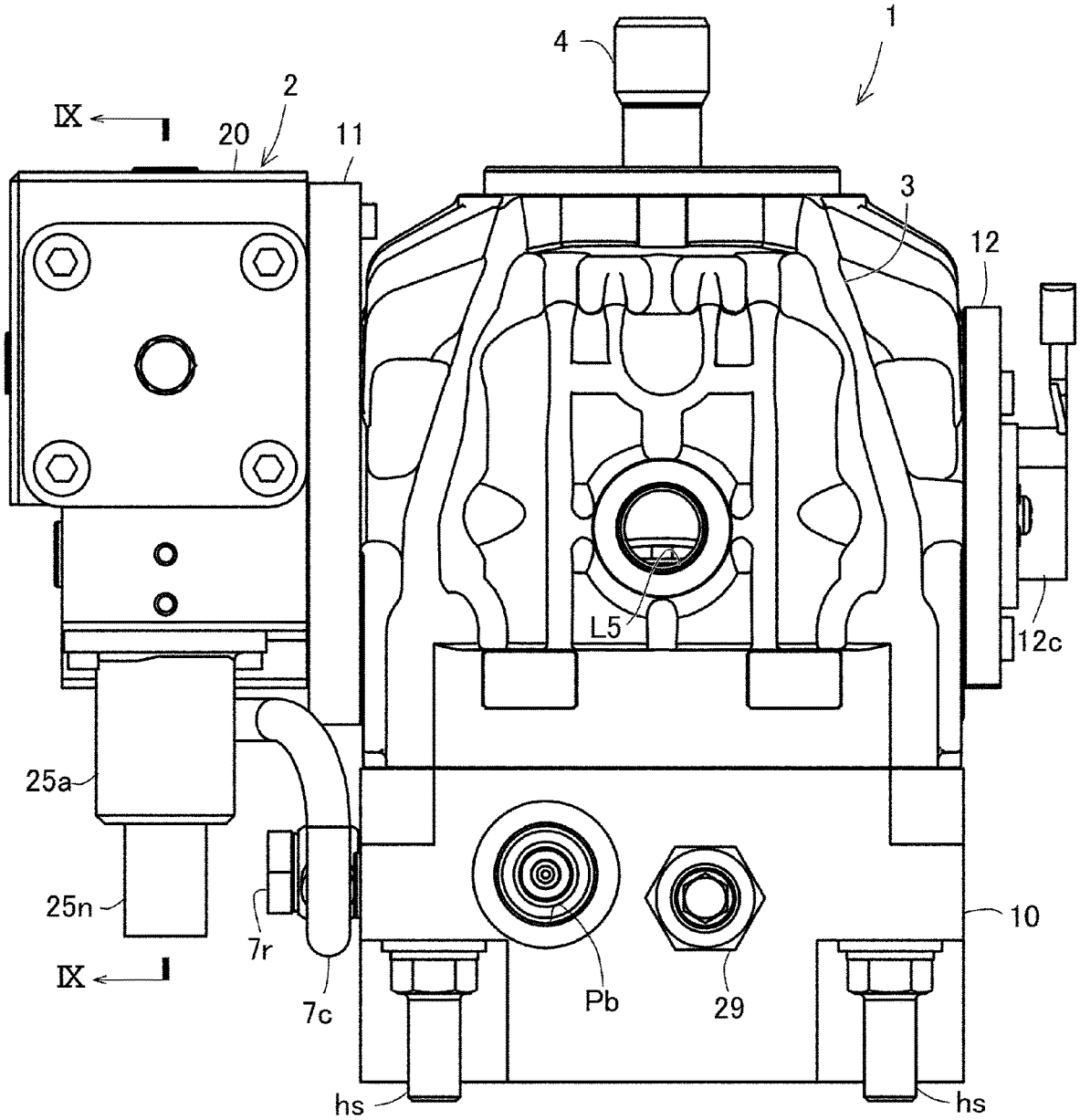
FIG. 3 is a front view of the hydraulic pump having the servo unit attached thereto.

An arrangement of hydraulic pump 1 and servo unit 2 is not limited. However, following description of the embodiment of hydraulic pump 1 will be given on an assumption that a drive shaft 4 of hydraulic pump 1 is extended vertically, a rotary axis of movable swash plate 6 is oriented laterally, and servo unit 2 is attached onto a left side of hydraulic pump 1 when viewed in front as shown in FIG. 3. In other words, which direction is referred to as right or left is based on the front view as shown in FIG. 3.

Hydraulic pump 1 having servo unit 2 attached thereto is configured so that fluid can flow between hydraulic pump 1 and servo unit 2 via a hose 7*c*, pipe joints 7*s* and 7*r* at opposite ends of hose 7*c*, a servo port Ps, a return port Pr, and so on. When an operator manipulates a speed changing or traveling direction selecting manipulator (not shown), e.g., a pedal or a lever, servo unit 2 controls tilt direction and angle of movable swash plate 6 in correspondence to an operation position of the manipulator, thereby controlling the flow direction and amount of fluid delivered from hydraulic pump 1.

Figure 2:
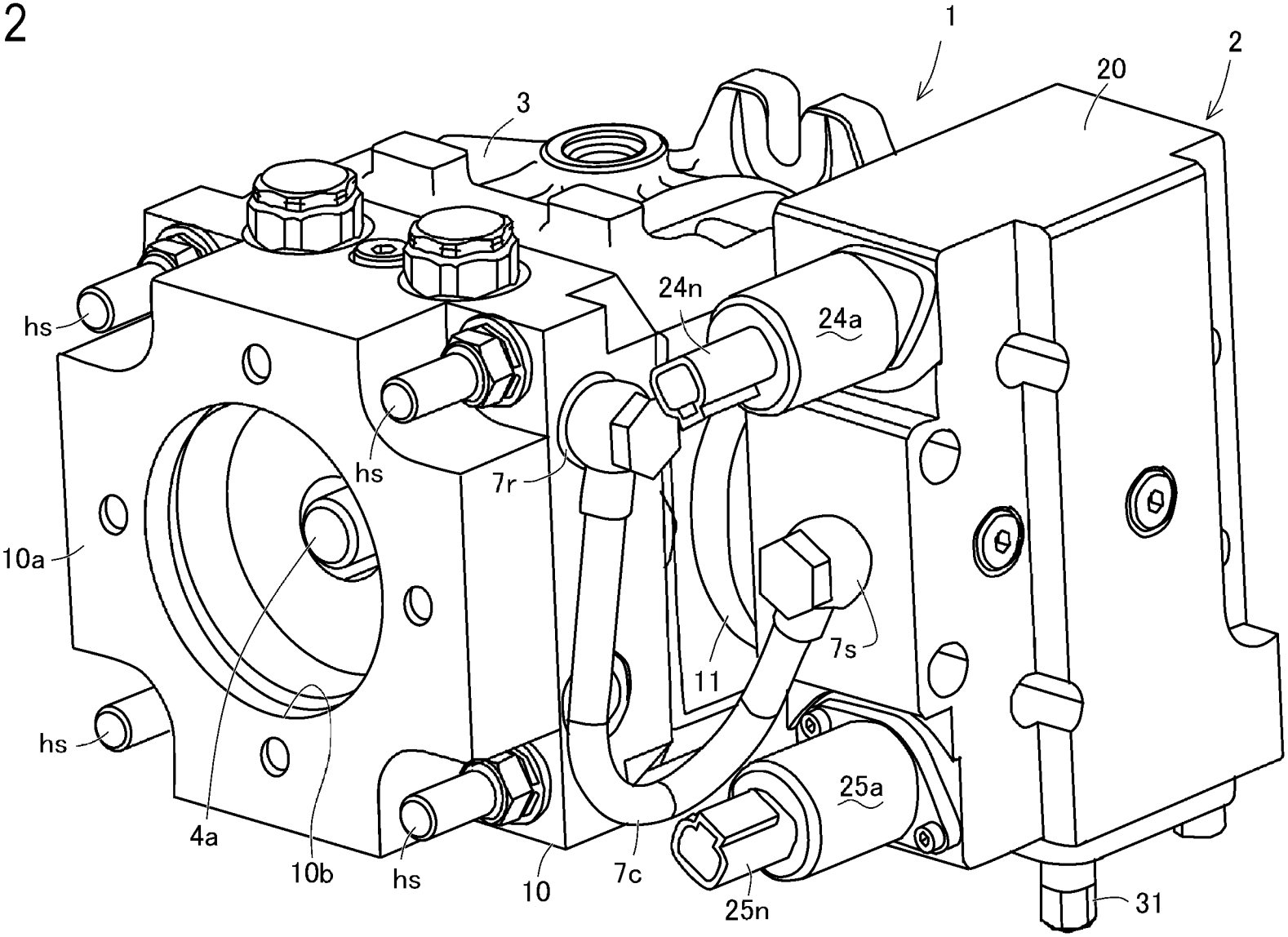
FIG. 2 is a perspective bottom view of the hydraulic pump having the servo unit attached thereto.

Referring to FIG. 2, servo unit 2 includes proportional solenoids 24*a* and 25*a* provided with respective connectors 24*n* and 25*n*. An electric circuit (not shown) is connected to connectors 24*n* and 25*n* so that, when the manipulator is manipulated, an electric current is applied to proportional solenoid 24*a* or 25*a* in correspondence to the operation position of the manipulator, whereby the tilt angle and direction of movable swash plate 6 are controlled in correspondence to the electric current applied to proportional solenoid 24*a* or 25*a*. As discussed later, a value of the electric current applied to proportional solenoid 24*a* or 25*a* is referred to as a control current value.

Figure 4:
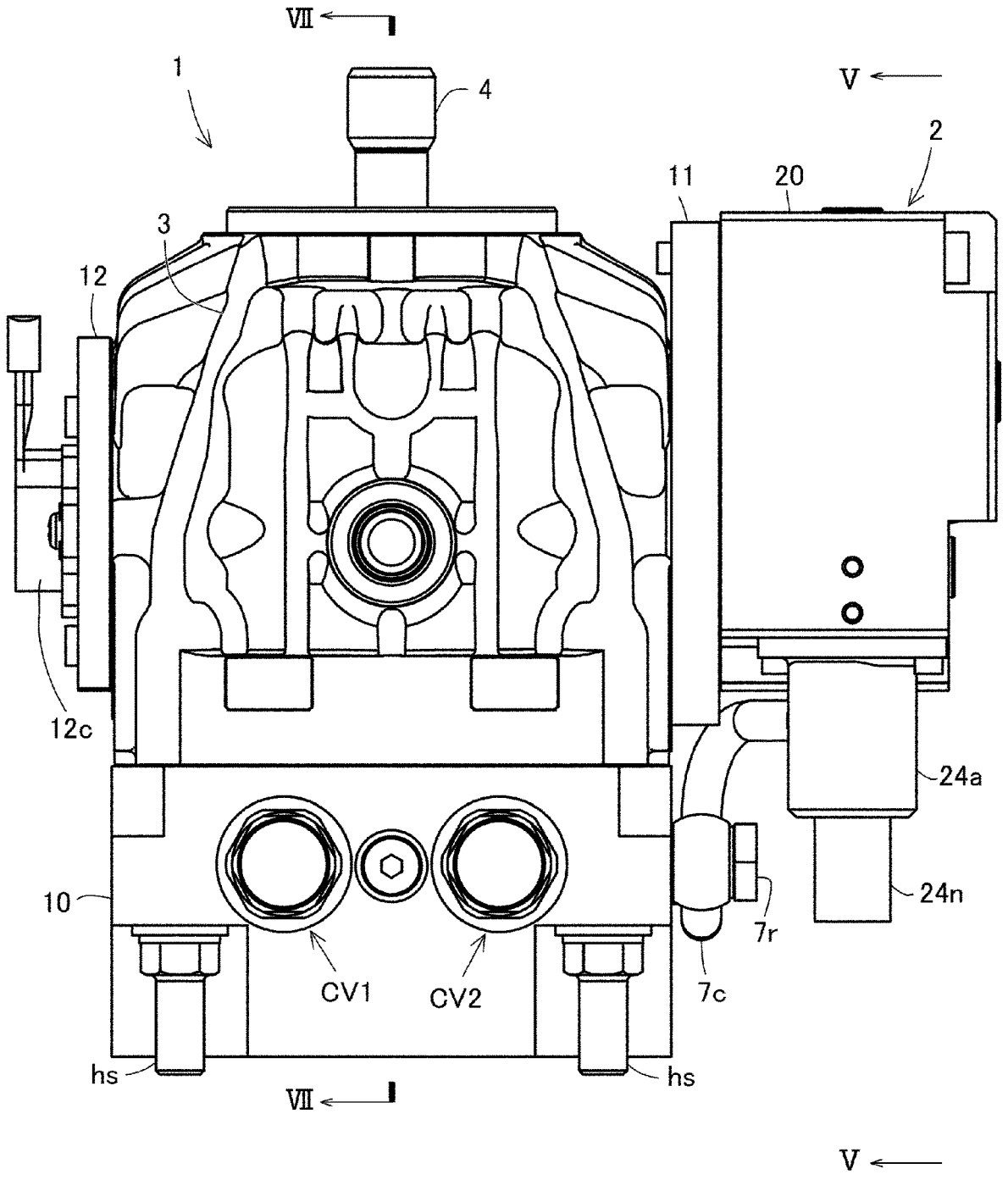
FIG. 4 is a rear view of the hydraulic pump having the servo unit attached thereto.
Figure 5:
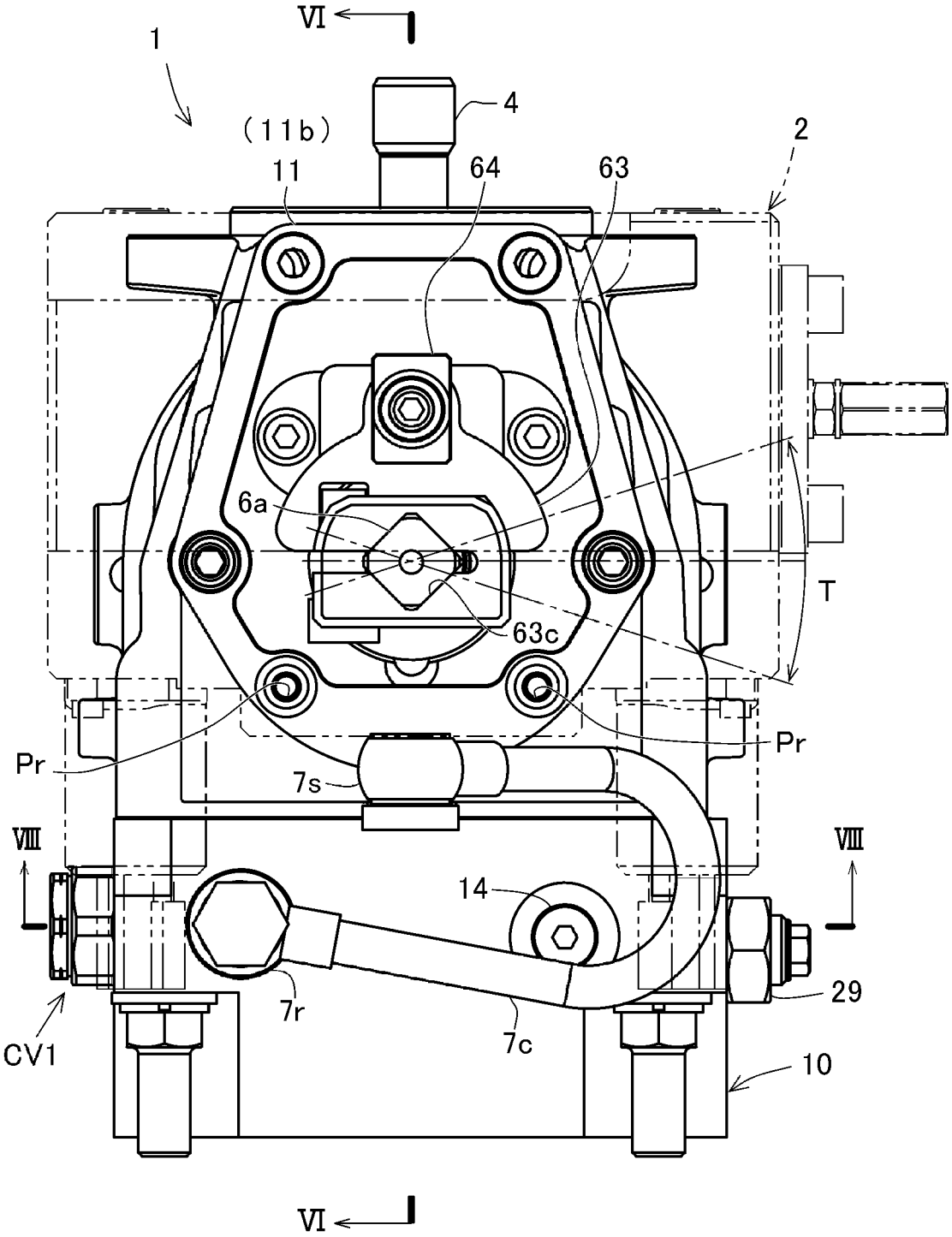
FIG. 5 is a left side view of the hydraulic pump from which the servo unit has been removed, when viewed as directed by arrows V in FIG. 4.

Referring to FIGS. 3 to 5, hydraulic pump 1 includes a port block 10, a housing 3, and drive shaft 4. Housing 3 serves as an outer frame of hydraulic pump 1. Port block 10 is fixed to a bottom portion of housing 3. Drive shaft 4 is drivingly connected to the prime mover (the power source), e.g., an engine, so as to receive power from the prime mover.

Figure 6:
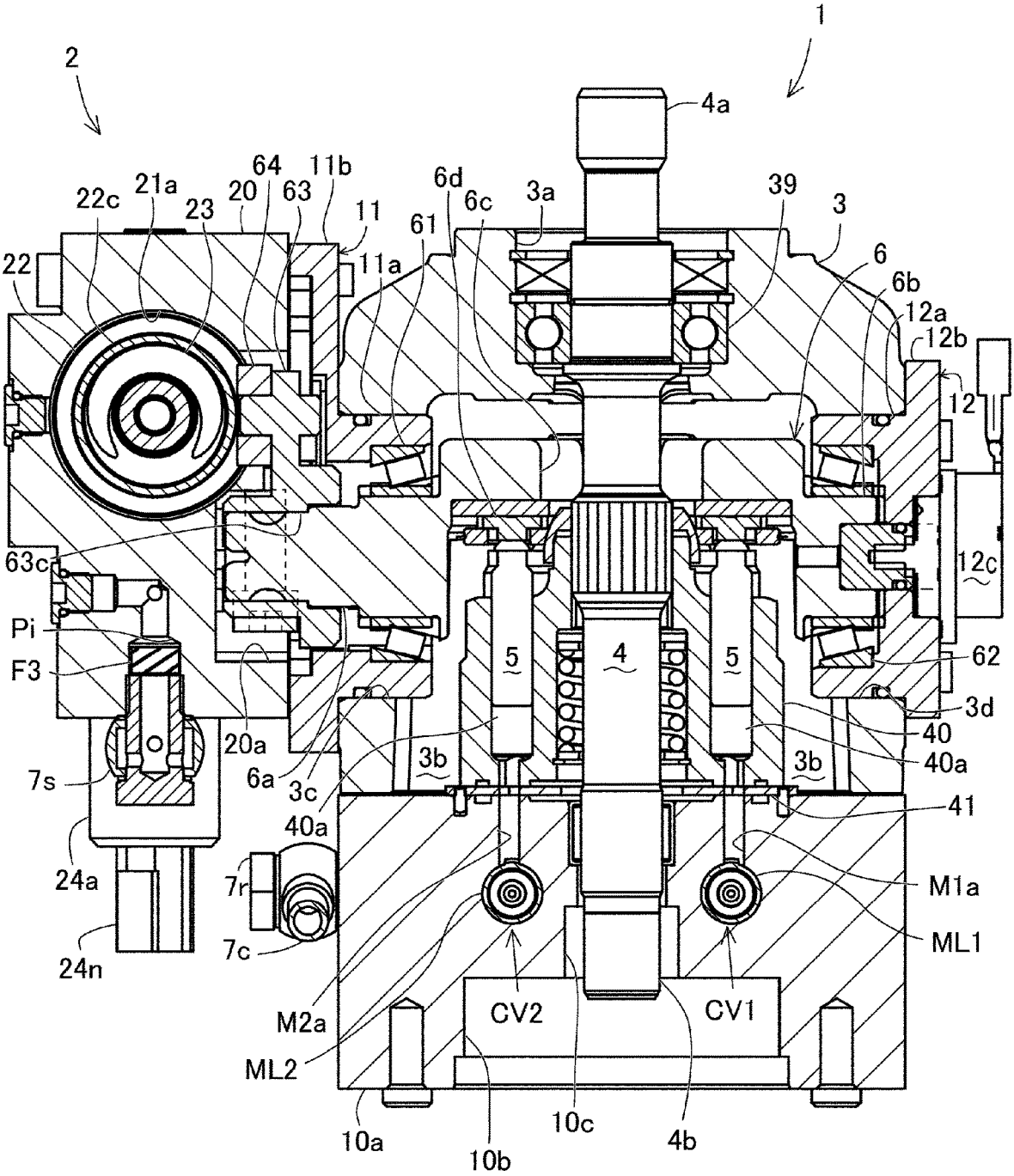
FIG. 6 is a cross sectional view taken along VI-VI line of FIG. 5.
Figure 7:
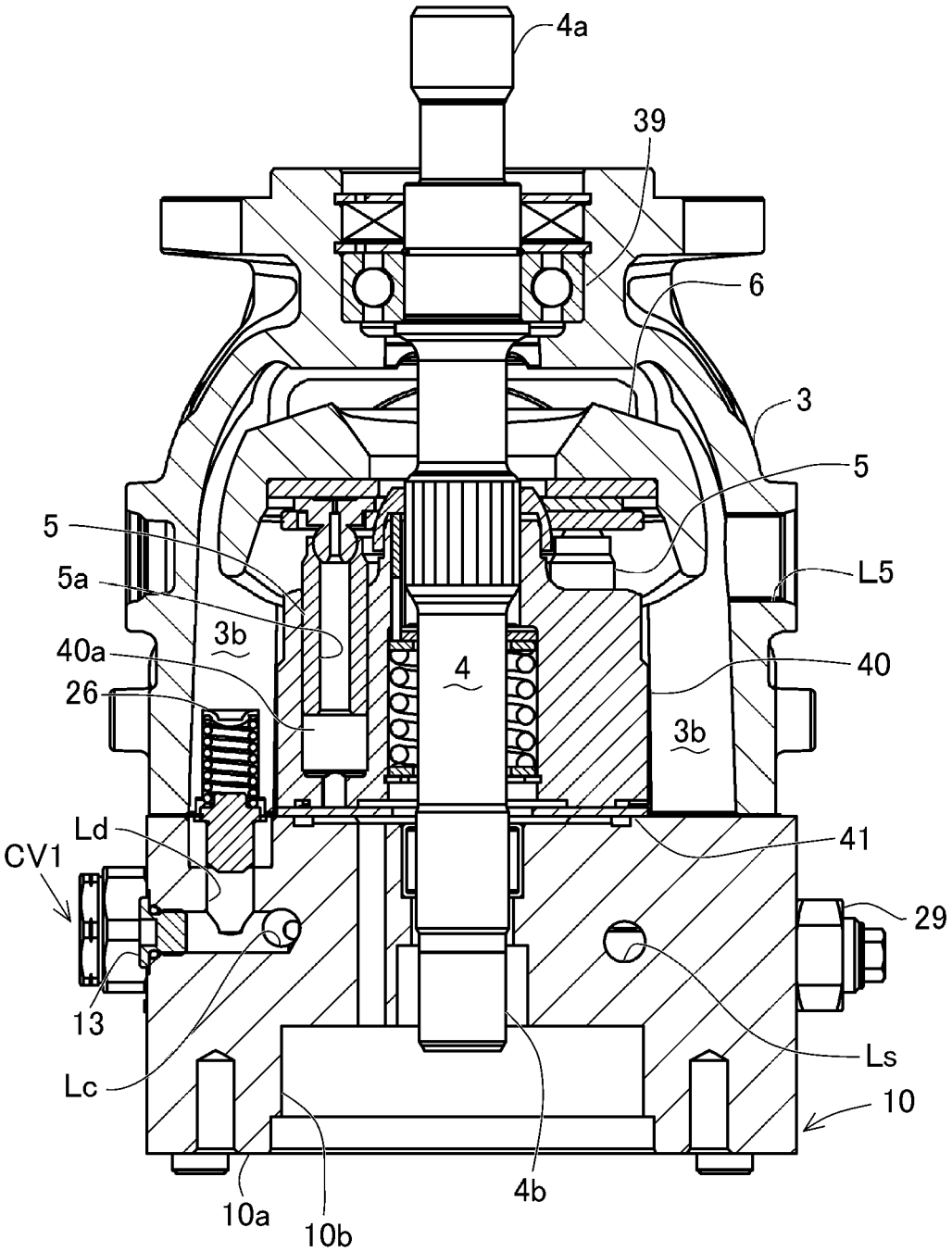
FIG. 7 is a cross sectional view taken along VII-VII line of FIG. 4.

Referring to FIGS. 6 and 7, hydraulic pump 1 includes a cylinder block 40, plungers 5 and movable swash plate 6. Housing 3 incorporates cylinder block 40, plungers 5 and movable swash plate 6. A space between housing 3 and cylinder block 40 serves as a fluid sump 3*b*.

Drive shaft 4 serves as an input shaft (or a pump shaft) of hydraulic pump 1. Drive shaft 4 is journalled by housing 3 via a bearing 39, and is inserted into cylinder block 40 and port block 10. Cylinder block 40 is fixed on drive shaft 4 rotatably integrally with drive shaft 4.

Referring to FIG. 7, plungers 5 are fitted into respective cylinders 40*a* formed in cylinder block 40 so as to be vertically reciprocally slidable parallel to drive shaft 4. Movable swash plate 6 includes a thrust bearing 6*d* abutting against heads of all plungers 5. Each plunger 5 is formed therein with a fluid passage 5*a*.

Cylinder block 40 is slidably and rotatably fitted to a horizontal top plane surface of port block 10 via a valve plate 41 fixed to the top plane surface of port block 10 (or may be fitted to the top surface of port block 10 without valve plate 41). A rotational position of movable swash plate 6, where thrust bearing 6*d* of movable swash plate 6 abutting plungers 5 is disposed horizontally parallel to the horizontal top surface of port block 10 (and valve plate 41), is defined as a neutral position of movable swash plate 6. In other words, the tilt angle of movable swash plate 6 at the neutral position is zero, where movable swash plate 6 is not tilted in either of opposite directions therefrom.

Referring to FIG. 6, movable swash plate 6 is formed with a pair of trunnion shaft portions 6*a* and 6*b*. Movable swash plate 6 is formed with an opening 6*c* at a center portion thereof between trunnion shaft portions 6*a* and 6*b*. Vertical drive shaft 4 is passed through opening 6*c* so as to penetrate movable swash plate 6.

Each of trunnion shaft portions 6*a* and 6*b* has a proximal end extended vertically downward from a lower edge of an inner circumferential surface in the center portion of movable swash plate 6 defining opening 6*c*, and extends from the proximal end thereof to a distal end thereof in the lateral horizontal direction of hydraulic pump 1. In other words, trunnion shaft portions 6*a* and 6*b* have respective lateral horizontal axes that are coaxial to each other. The lateral horizontal axes of trunnion shaft portions 6*a* and 6*b* serve as the rotary axis of movable swash plate 6.

A central top portion of housing 3 is formed therein with an opening 3*a*. Bearing 39 is fitted in opening 3*a* to journal an upper portion of drive shaft 4. Port block 10 has a bottom surface 10*a* formed at a center portion thereof with a recess 10*b*. Port block 10 is bored through from a top surface thereof to recess 10*b* with a vertical shaft hole 10*c*. A top end 4*a* of drive shaft 4 projects upward from opening 3*a*. A bottom end 4*b* of drive shaft 4 is inserted into shaft hole 10*c*.

Bottom end 4*b* of drive shaft 4 is drivingly connected to a drive shaft for external pumps 8*a*, 8*b* and 8*c* (see FIG. 10) attached to bottom surface 10*a* of port block 10 as discussed later. Alternatively, drive shaft 4 may be extended downward from port block 10 into external pumps 8*a*, 8*b* and 8*c* so as to serve as a drive shaft for external pumps 8*a*, 8*b* and 8*c*.

Further, in this embodiment, a line filter F2 is externally attached to hydraulic pump 1 as discussed later. Alternatively, a filter may be disposed in recess 10*b* of port block 10 in correspondence to a different kind of hydraulic pump 1.

Housing 3 is formed at left and right side portions thereof with respective openings 3*c* and 3*d*. Left and right supporters 11 and 12 are fitted into respective left and right openings 3*c* and 3*d* so as to support respective left and right trunnion shaft portions 6*a* and 6*b* disposed in respective openings 3*c* and 3*d*.

Supporter 11 is formed with a sleeve portion 11*a* and a flange portion 11*b*. Sleeve portion 11*a* is fitted into left opening 3*c* so that an outer circumferential surface of sleeve portion 3*c* contacts an inner circumferential surface defining opening 3*c* in the left side portion of housing 3. Flange portion 11*b* is extended centrifugally from a distal (left) end of sleeve portion 11*a* along a left outer side surface of housing 3 outward from opening 3*c* so as to contact the left outer side surface of housing 3.

Supporter 12 is formed with a sleeve portion 12*a* and a flange portion 12*b*. Sleeve portion 12*a* is fitted into right opening 3*d* so that an outer circumferential surface of sleeve portion 3*d* contacts an inner circumferential surface defining opening 3*d* in the right side portion of housing 3. Flange portion 12*b* is extended centrifugally from a distal (right) end of sleeve portion 12*a* along a right outer side surface of housing 3 outward from opening 3*d* so as to contact the right outer side surface of housing 3.

Left trunnion shaft portion 6*a* is passed through sleeve portion 11*a* of left supporter 11 so as to project at the distal (left) end thereof outward (leftward) from flange portion 11*b* of supporter 11. A bearing 61 is interposed between an inner circumferential surface of sleeve portion 11*a* and an outer circumferential surface of trunnion shaft portion 6*a*. The distal (right) end of right trunnion shaft portion 6*b* is disposed in sleeve portion 12*a* of right supporter 12. A bearing 62 is interposed between an inner circumferential surface of sleeve portion 12*a* and an outer circumferential surface of trunnion shaft portion 6*b*.

Therefore, left trunnion shaft portion 6*a* is supported by the left side wall portion of housing 3 via bearing 61 and supporter 11 so as to be rotatable relative to supporter 11 and housing 3 via bearing 61. Right trunnion shaft portion 6*b* is supported by the right side wall of housing 3 via bearing 62 and supporter 12 so as to be rotatable relative to supporter 12 and housing 3 via bearing 62. In this way, two trunnion shaft portions 6*a* and 6*b* are supported by the opposite side portions of housing 3 via respective bearings 61 and 62 so that movable swash plate 6 is supported by housing 3 so as to be rotatable relative to housing 3.

Flange portion 11*b* of left supporter 11 is expanded radially enough to support large and heavy servo unit 2. A servo housing 20 of servo unit 2, flange portion 11*b* of supporter 11, and the left side wall portion of housing 3 of hydraulic pump 1 are provided with respective bolt holes coinciding to one another.

When a right end surface of servo housing 20 contacts flange portion 11*b*, servo housing 20 is fastened to flange portion 11*b* by bolts, and flange portion 11*b* is fastened together with servo housing 20 to the left side wall portion of housing 3 by bolts, whereby servo unit 2 is detachably attached to hydraulic pump 1 via supporter 11. The distal left end of trunnion shaft portion 6*a* projecting leftward from flange portion 11*b* is disposed in servo unit 2 so as to be connected to a piston 22 in servo unit 2.

On the other hand, flange portion 12*b* of right supporter 12 which does not have to support servo unit 2 has an only enough radial size to be fastened to the right side wall portion of housing 3 by bolts while supporting a small and light angle sensor 12*c*. Angle sensor 12*c*, e.g., a potentiometer, is connected to the right distal end portion of trunnion shaft portion 6*b* in sleeve portion 12*a* through flange portion 12*b* of supporter 12 so as to detect a tilt condition (i.e., tilt angle and direction) of movable swash plate 6. Angle sensor 12*c* is connected to a controller (not shown) so as to transmit a feedback signal to the controller during actuation of servo unit 2.

An arm 63 is joined to the distal end portion of trunnion shaft portion 6*a*. Referring to FIG. 5, the distal end portion of trunnion shaft portion 6*a* is formed in a square shape when viewed in the axial direction of trunnion shaft portion 6*a*. Arm 63 is formed in a basal end portion thereof with a square through hole 63*c* corresponding to the square distal end portion of trunnion shaft portion 6*a*. The distal end portion of trunnion shaft portion 6*a* is fitted into hole 63*c* and is fastened to the basal end portion of arm 63 by a radial lock pin.

Arm 63 is extended from the basal end portion thereof to a tip portion thereof in a radial direction of trunnion shaft portion 6*a*. A key member 64 is mounted on a left side surface of the tip portion of arm 63 opposite housing 3. Therefore, arm 63 and key member 64 are rotatable integrally with trunnion shaft portion 6*a* centered on the lateral horizontal axis of trunnion shaft portion 6*a*.

Figure 9:
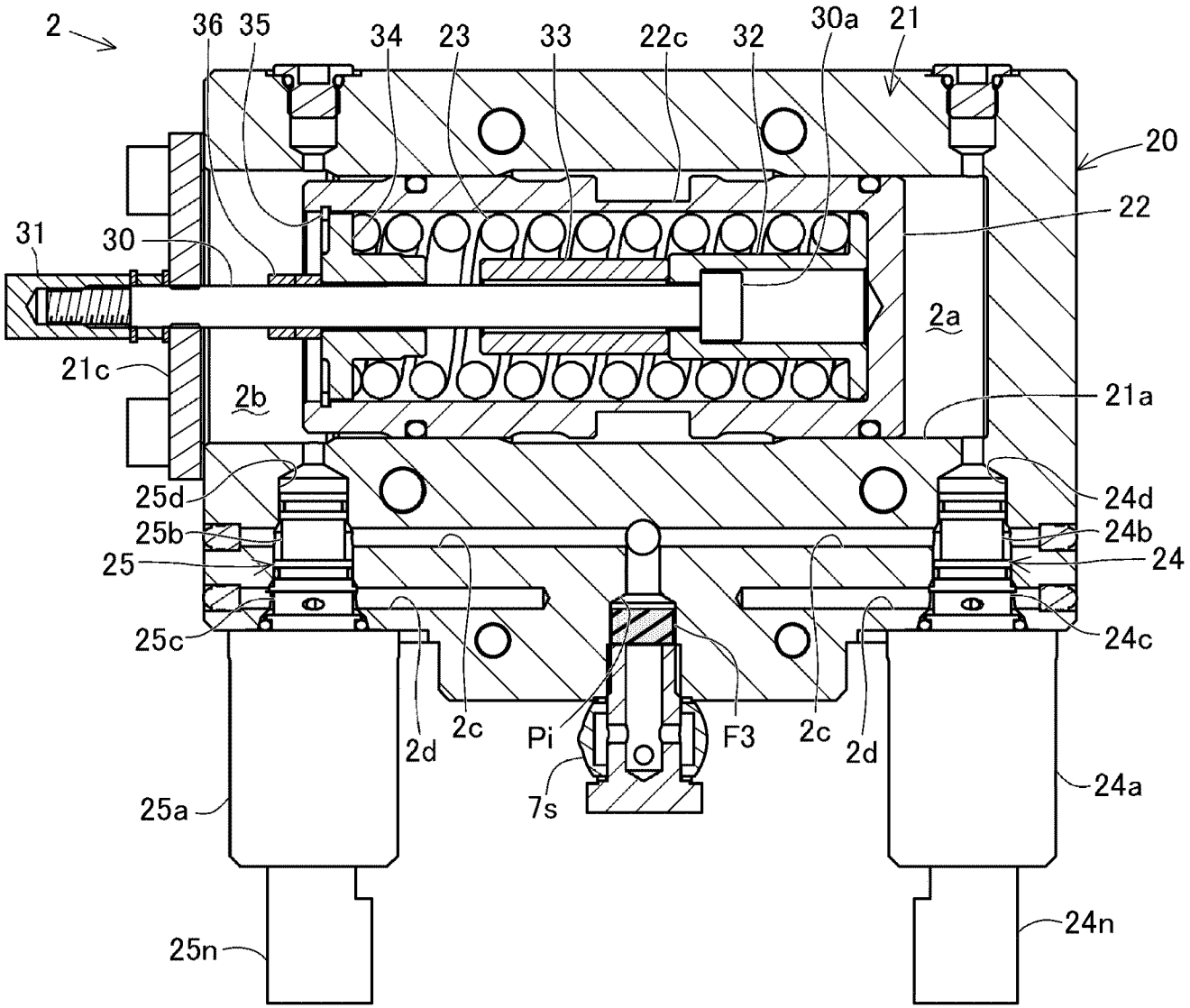
FIG. 9 is a cross sectional view taken along IX-IX line of FIG. 3.

Referring to FIGS. 6 and 9, a circular cylinder bore 21*a* is formed in servo housing 20 of servo unit 2 so as to extend in the fore-and-aft direction of hydraulic pump 1 and servo unit 2 perpendicular to the lateral horizontal axis of trunnion shaft portion 6*a*. Columnar piston 22 is disposed in cylinder bore 21*a*.

Flange portion 11*b* of supporter 11 is arranged to surround an opening in which a right half portion of arm 63 facing housing 3 is accommodated so as to be allowed to rotate centered on the axis of trunnion shaft portion 6*a*. On the other hand, servo housing 20 whose right end surface contacts flange portion 11*b* is formed with a recess 20*a* that is open rightward to face the opening surrounded by flange portion 11*b*, so that a left half portion of arm 63 is accommodated in recess 20*a* so as to be allowed to rotate centered on the axis of trunnion shaft portion 6*a*.

An upper portion of recess 20*a* is joined to cylinder bore 21*a*, so that key member 64 provided on the left side of the tip portion of arm 63 is fitted into an annular groove 22*c* formed on an axial intermediate portion of piston 22 in cylinder bore 21*a* via the upper portion of recess 20*a*. Therefore, key member 64, arm 63 and movable swash plate 6 are rotated centered on the axis of trunnion shaft portions 6*a* and 6*b* according to slide of piston 22 in cylinder bore 21*a*. A whole slide range of piston 22 defines a whole tilt angle range of movable swash plate 6 having an extension of an angle T (see FIG. 5).

During a forward traveling of a vehicle, a tilt angle of movable swash plate 6 is controlled in a half range having an extension of a half of angle T in one of opposite directions from a zero angle position. During a backward traveling of the vehicle, a tilt angle of movable swash plate 6 is controlled in another half range having an extension of a half of angle T in the other of the opposite directions from the zero angle position.

For example, a rotation range of movable swash plate 6 having the extension of the half of angle T upward from the zero angle position to an upper maximum angle position is allotted for forward traveling speed change of a vehicle, and another rotation range of movable swash plate 6 having the extension of the half of angle T from the zero angle position to another lower maximum angle position is allotted for backward traveling speed change of the vehicle.

In hydraulic pump 1 and servo unit 2 assembled together, neither trunnion shaft portion 6*a* nor arm 63 is fixed to servo housing 20, and neither the tip portion of arm 63 nor key member 64 is fixed to piston 22. Therefore, as servo unit 20 unfastened from supporter 11 by releasing bolts or in another manner is moved away from supporter 11, servo housing 20 and piston 22 are naturally separated from trunnion shaft portion 6*a*, arm 63 and key member 64, thereby easily detaching servo unit 2 from hydraulic pump 1 as shown in FIG. 1.

On the other hand, when servo housing 20 is brought closer to supporter 11 to attach servo unit 2 to hydraulic pump 1, trunnion shaft portion 6*a* having arm 63 fixed thereon is inserted into opening 20*a*, and key member 64 is fitted into annular groove 22*a* of piston 22. Then, servo unit 20 is fastened to supporter 11 by bolts, thereby easily completing attachment of servo unit 2 to hydraulic pump 1.

In this way, servo unit 2 can easily be attached and detached to and from hydraulic pump 1, thereby facilitating maintenance of hydraulic pump 1 and servo unit 2. Hydraulic pump 1 can be provided with an alternative mechanical linkage or actuator for controlling or adjusting a tilt angle of movable swash plate 6, instead of servo unit 2. In other words, common hydraulic pump 1 is used to provide either hydraulic pump 1 with servo unit 2 or hydraulic pump 1 with the mechanical linkage or actuator.

A fluid passage system formed in port block 10 will be described with reference to FIGS. 6 to 8 and 11.

Figure 8:
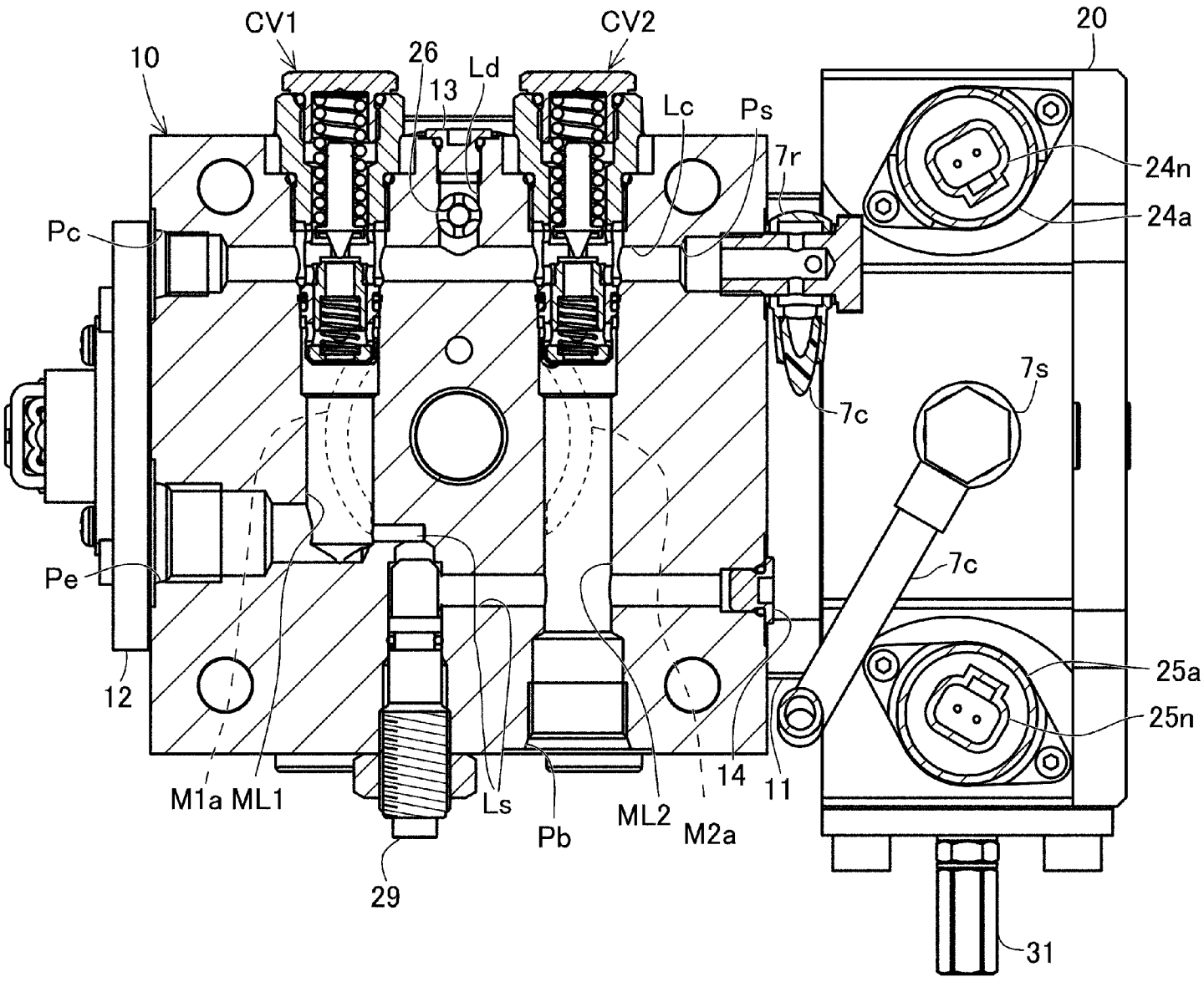
FIG. 8 is a cross sectional view taken along VIII-VIII line of FIG. 5.

Referring to FIG. 8, port block 10 is substantially rectangular in section. Port block 10 is provided with externally open ports, including a gauge port Pc for introducing fluid into port block 10, a servo port Ps for discharging fluid from port block 10, and a pair of main ports Pb and Pe each of which alternately serves as either a suction port or a discharge port.

Servo port Ps is externally open at one side surface of port block 10, and gauge port Pc is externally open at another side surface of port block 10, so that gauge port Pc and servo port Ps are opposite each other with respect to port block 10. Port block 10 is formed therein with a fluid-charge passage Lc fluidly connecting gauge port Pc and servo port Ps to each other.

Fluid-charging passage Lc is disposed in a rear portion of port block 10 rearward from the lower portion of drive shaft 4 in port block 10. Fluid-charging passage Lc is extended parallel to front and rear end surfaces of port block 10, i.e., in the lateral direction of hydraulic pump 1, so as to penetrate port block 10 between the right and left end surfaces of port block 10. An externally open end of fluid-charge passage Lc at one of the right and left end surfaces (in this embodiment, the left end surface) of port block 10 serves as servo port Ps. Another externally open end of fluid-charge passage Lc at the other of the right and left end surfaces (in this embodiment, the right end surface) of port block 10 serves as gauge port Pc.

Referring to FIGS. 7 and 8, a charge relief valve 26 for regulating a pressure of hydraulic fluid flowing in fluid-charge passage Lc is fitted in port block 10 so as to be fluidly connected to fluid-charge passage Lc via a fluid-drain passage Ld formed in port block 10.

Fluid-draining passage Ld is extended rearward from a front end thereof and is joined to fluid-charge passage Lc between charge valve units CV1 and CV2 to a rear end thereof at the rear end surface of port block 10. The rear end of fluid-drain passage Ld at the rear end surface of port block 10 is plugged by a cap 13.

Charge relief valve 26 is extended vertically from port block 10 to the inside space of housing 3 serving as fluid sump 3*b*, so that an upper portion of charge relief valve 26 is disposed in housing 3, while a lower portion of charge relief valve 26 is disposed in port block 10. In port block 10, fluid-drain passage Ld is branched upward from a portion thereof between the front end thereof connected to fluid-charge passage Lc and the rear end thereof plugged by cap 13, and is fluidly connected at a top thereof to charge relief valve 26.

Therefore, charge relief valve 26 receives hydraulic fluid from fluid-charge passage Lc via fluid-drain passage Ld. When a pressure of the fluid exceeds a relief pressure set in charge relief valve 26, charge relief valve 26 is opened to discharge excessive fluid to fluid sump 3*b* in housing 3 so as to regulate the pressure of hydraulic fluid in fluid-charge passage Lc to be supplied to a main fluid passage ML1 or ML2 via charge valve unit CV1 or CV2.

A pair of bores serving as main fluid passages ML1 and ML2 are formed in port block 10 so as to extend forward from respective rear ends thereof at the rear end surface of port block 10 and parallel to each other, thereby crossing fluid-charge passage Lc extended in the lateral direction of hydraulic pump 1.

Charge valve units CV1 and CV2 are inserted forward into the respective bores serving as main fluid passages ML1 and ML2 from the rear ends of the bores and across fluid-charge passage Lc.

In other words, lateral fluid-charge passage Lc penetrating port block 10 between the right and left end surfaces of port block 10 crosses charge valve units CV1 and CV2, so that main fluid passage ML1 is extended forward from charge valve unit CV1 so as to be joined at an upper portion thereof to a kidney port M1*a* open at the top plane surface of port block 10, and main fluid passage ML2 is extended forward from charge valve unit CV2 so as to be joined at an upper portion thereof to a kidney port M2*a* open at the top plane surface of port block 10.

A front end of main fluid passage ML2 is open at the front end surface of port block 10 so as to serve as a main port Pb. Main fluid passage ML1 is bent at the front end thereof in a rightward direction opposite to servo unit 2 so as to have an open end serving as a main port Pe at the right end surface of port block 10.

A bypass valve 29 is disposed rightward from main port Pb, and is fitted into port block 10 rearward from the front end surface of port block 10.

In a front portion of port block 10 forward from the lower portion of drive shaft 4 in port block 10, a bore serving as a fluid-bypass passage Ls is extended leftward from bypass valve 29 and across a front portion of main fluid passage ML2 between charge valve unit CV2 and main port Pb. An open end of the bore at the left end surface of port block 10 is plugged by a cap 14.

Another bore serving as fluid-bypass passage Ls is extended rearward from bypass valve 29, and is bent rightward so as to be joined to the bent front end portion of main fluid passage ML1. Therefore, fluid-bypass passage Ls having bypass valve 29 on an intermediate portion thereof is interposed between main fluid passages ML1 and ML2.

Valve plate 41 is formed with a pair of ports coinciding to respective kidney ports M1*a* and M2*a* open at the top plane surface of port block 10 so as to serve as fluid suction and delivery ports for cylinders 40*a* in cylinder block 40.

Hydraulic fluid flows between main fluid passages ML1 and ML2 and fluid passages 5*a* in plungers 5 via the fluid suction and delivery ports in valve plate 41. A stroke of plungers 5 is determined in correspondence to the tilt angle of movable swash plate 6. Either main fluid passage ML1 or ML2 is determined as a higher-pressurized main fluid passage in correspondence to the tilt direction of movable swash plate 6. Therefore, the fluid delivery from hydraulic pump 1 to the hydraulic motor is controlled in direction and in quantity per unit time.

Mutually parallel main fluid passages ML1 and ML2 cross fluid-charge passage Lc extended perpendicular to main fluid passages ML1 and ML2 so that fluid passages ML1, ML2 and Lc can be formed in port block 10 easily by boring, thereby facilitating processing of port block 10 for forming the fluid passages therein.

Externally open ports Pc, Ps, Pb and Pe and valves CV1, CV2 and 29 are distributed on the four side surfaces of port block 10 so as to minimize hydraulic pump 1 in the fore-and-aft and lateral directions thereof.

To assemble charge relief valve 26 into port block 10, a vertical bore is formed in port block 10 to serve as the above-mentioned upwardly branching portion of fluid-drain passage Ld joined at the bottom end thereof to the fore-and-aft horizontal bore serving as fluid-drain passage Ld, so that the lower portion of charge relief valve 26 is easily inserted downward into the vertical bore in port block 10. Then, port block 10 is fixed to the bottom portion of housing 3 so that the upper portion of charge relief valve 26 projecting outward from port block 10 is naturally disposed in the inside space of housing 3, whereby no additional fluid passage is needed to return fluid released from charge relief valve 26 to fluid sump 3*b* in housing 3.

Servo unit 2 will be described mainly with reference to FIG. 9.

As mentioned above, servo unit 2 includes servo housing 20 formed therein with cylinder bore 21*a*. Cylinder bore 21*a* is oriented in the fore-and-aft horizontal direction when the right side surface of servo housing 20 contacts supporter 11 so as to attach servo unit 2 to hydraulic pump 1 as mentioned above.

Piston 22, a spring 23, a spring retainer 32, a stopper collar 33 and a spring retainer 34 are disposed in cylinder bore 21*a* so as to constitute a hydraulic cylinder 21 serving as a hydraulic actuator for controlling tilt direction and angle of movable swash plate 6.

Spring retainer 32, stopper collar 33 and spring retainer 34 are aligned in the fore-and-aft direction, and are disposed in sleeve-shaped piston 22. Since FIG. 3 is defined as the front view of hydraulic pump 1 and servo unit 2, cylinder bore 21*a* and piston 22 are defined as being closed at the rear ends thereof and being open at the front ends thereof. Spring retainer 32 is defined as rear spring retainer 32, and spring retainer 34 is defined as front spring retainer 34. Therefore, stopper collar 33 is disposed between rear spring retainer 32 and front spring retainer 34.

Compressed coiled spring 23 is interposed between rear spring retainer 32 and front spring retainer 34 around stopper collar 33 in piston 22. Spring 23 biases rear spring retainer 32 rearward, and biases front spring retainer 34 forward, thereby biasing piston 22 toward a neutral position in cylinder bore 21*a*. In piston 22 at the neutral position, the rear end of rear spring retainer 32 is pressed to abut against the rear end portion of piston 22, and the front end of front spring retainer 34 is pressed to abut against a retaining ring 35 fixed to an inner circumferential edge of the open front end of piston 22, as shown in FIG. 9.

The inside space of cylinder bore 21*a* includes a rear portion between the rear end of piston 22 and the closed rear end of cylinder bore 21*a*. The rear portion of the inside space of cylinder bore 21*a* serves as a hydraulic fluid chamber 2*a*. The inside space of cylinder bore 21*a* includes a front portion between the front end of front spring retainer 34 disposed at the open front end of piston 22 and a front end of cylinder bore 21*a* defined by a cover plate 21*c* fixed to a front end surface of servo housing 20.

Rear spring retainer 32, stopper collar 33 and front spring retainer 34 are bored through by fore-and-aft axial center holes, through which a guide rod 30 is passed. Guide rod 30 is formed at a rear end thereof with a flange portion 30*a* disposed in sleeve-shaped rear spring retainer 32 so as to be slidable in the fore-and-aft direction. On the other hand, a stopper ring 36 is fixed on guide rod 30 in hydraulic fluid chamber 2*b*.

Therefore, a portion of guide rod 30 between flange portion 30*a* and stopper ring 36 has a constant length. This length is set so that, when piston 22 is disposed at the neutral position, flange portion 30*a* contacts the front end portion of rear spring retainer 32 abutting against the rear end portion of piston 22, and stopper ring 36 contacts the front end of front spring retainer 34 abutting against retaining ring 35. Conversely, piston 22 is disposed at the neutral position when rear spring retainer 32 contacts flange portion 30*a* of guide rod 30 and front spring retainer 34 contacts stopper ring 36 on guide rod 30.

The front portion of guide rod 30 is passed through hydraulic fluid chamber 2*b* and cover plate 21*c* so as to extend forward from cover plate 21*c*. The front end portion of guide rod 30 projecting forward from cover plate 21*c* is threaded on an outer circumferential portion thereof. A shaft cap 31 threaded on an inner circumferential portion thereof is disposed forward from cover plate 21*c*. The front end portion of guide rod 30 is screwed into shaft cap 31.

By rotating shaft cap 31, the depth of the front end portion of guide rod 30 entered into shaft cap 31 is adjusted so as to adjust the axial position of guide rod 30. In other words, flange portion 31*a* and stopper ring 36 are adjusted in location along the axial direction of guide rod 30 so as to adjust the neutral position of piston 22.

Rear changeover valve 24 and front changeover valve 25 are fitted into servo housing 20 from the bottom surface of servo housing 20. Rear changeover valve 24 controls flow and pressure of hydraulic fluid to rear hydraulic fluid chamber 2*a*. Front changeover valve 25 controls flow and pressure of hydraulic fluid to front hydraulic fluid chamber 2*b*.

Figure 11:
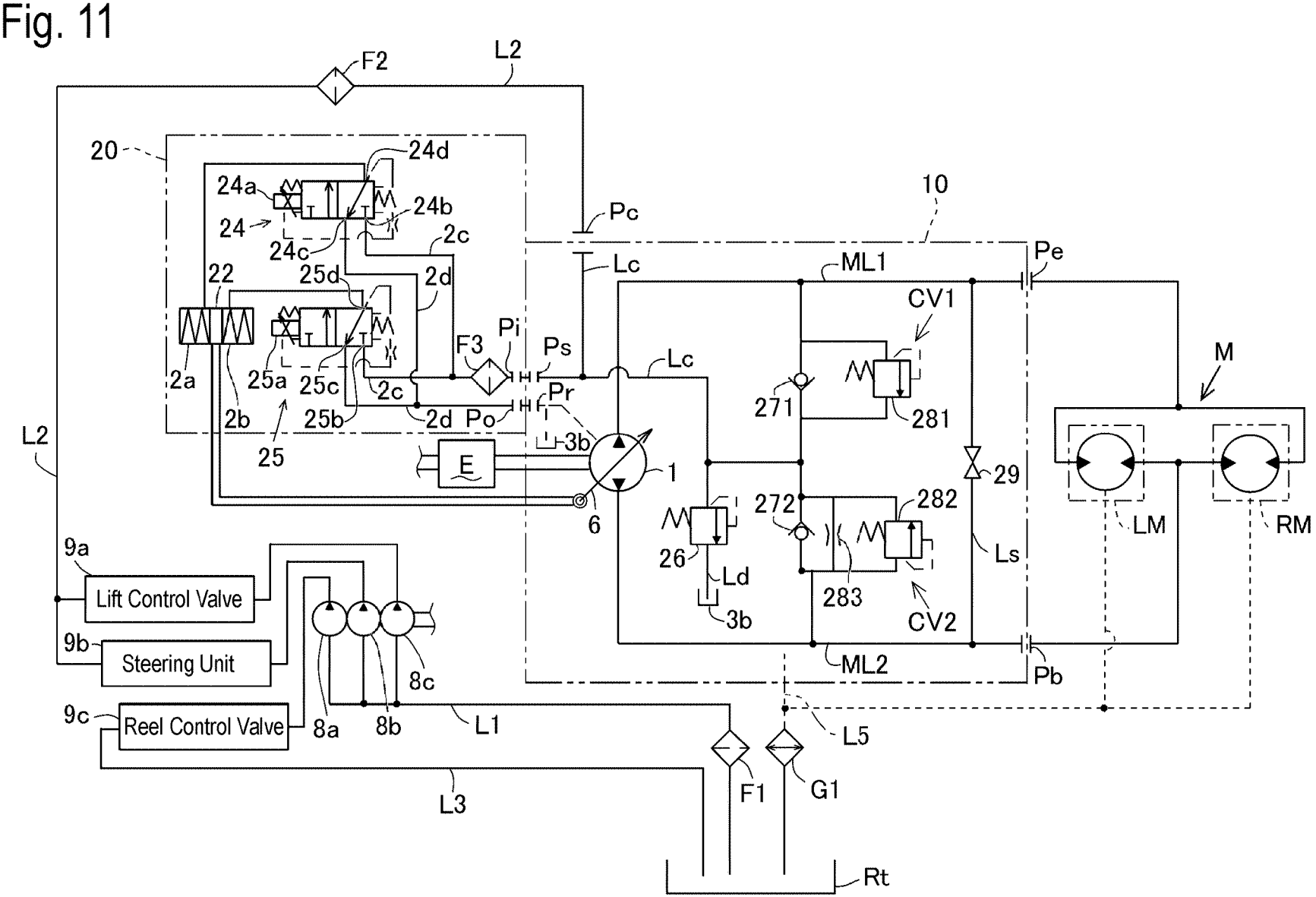
FIG. 11 is a circuit diagram of a hydraulic fluid supply system for an HST including the hydraulic pump and the servo unit as shown in FIG. 10.
Figure 12:
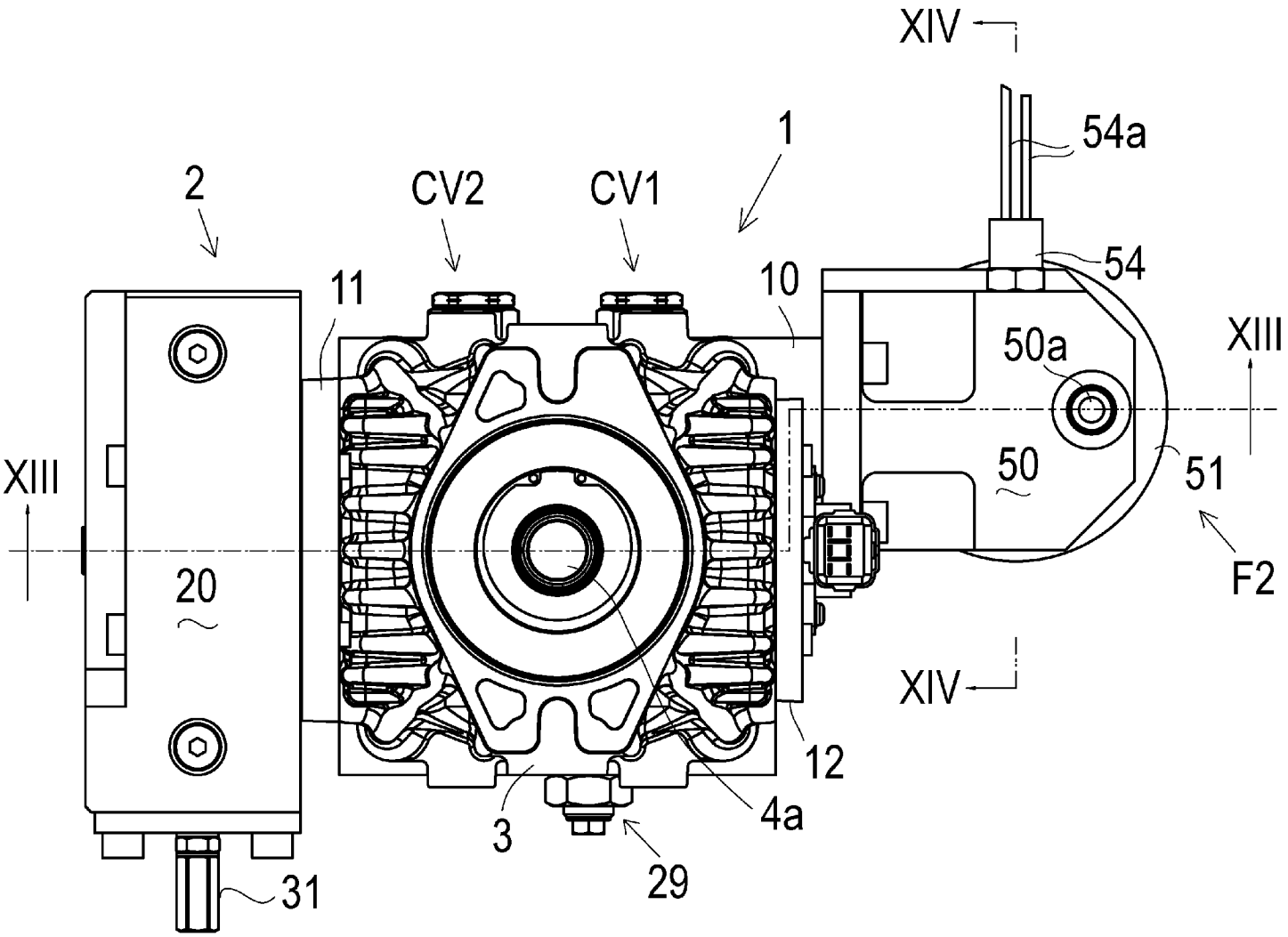
FIG. 12 is a plan view of an alternative hydraulic pump to which the servo unit, the line filter, and the external pumps are attached.

Changeover valves 24 and 25 includes respective suction ports 24*b* and 25*b*, respective discharge ports 24*c* and 25*c*, and respective suction/discharge ports 24*d* and 25*d* (see FIG. 11). Referring to FIG. 9, suction/discharge ports 24*d* and 25*d* are provided at respective top portions of changeover valves 24 and 25. Discharge ports 24*c* and 25*c* are provided at respective lower portions of changeover valves 24 and 25. Suction ports 24*b* and 25*b* are provided at respective vertically intermediate portions of changeover valves 24 and 25 between respective suction/discharge ports 24*d* and 25*d* and respective discharge ports 24*c* and 25*c*.

Referring to FIG. 9, a fluid-suction passage 2*c* is formed in a lower portion of servo housing 20 along the fore-and-aft direction (the longitudinal direction of servo housing 20) so as to connect suction ports 24*b* and 25*b* to each other.

Referring to FIGS. 6 and 9 and others, an inlet port Pi is open at the bottom surface of servo housing 20. Inlet port Pi is joined to fluid-suction passage 2*c* in servo housing 20. Pipe joint 7*s* is fitted into inlet port Pi. In servo housing 20, an internal filter F3 is disposed deeper than (upward from) pipe joint 7*s*.

As discussed later, hydraulic fluid introduced from hydraulic pump 1 into servo unit 2 is introduced to suction ports 24*b* and 25*b* of changeover valves 24 and 25 via inlet port Pi, filter F3 and fluid-suction passage 2*c* (see FIG. 11).

Referring to FIG. 1, a pair of front and rear return ports Pr are open at the left side surface of supporter 11 of hydraulic pump 1, and fluidly communicate to fluid sump 3*b* in housing 3 (see FIG. 6).

Servo housing 20 of servo unit 2 is provided at the right side surface thereof with a pair of front and rear outlet ports Po (see FIG. 11). Respective outlet ports Po coincide to respective return ports Pr when the right side surface of servo housing 20 contacts the left side surface of supporter 11 to attach servo unit 2 to hydraulic pump 1.

Referring to FIG. 9, servo housing 20 is formed with a pair of front and rear fluid-discharge passages 2*d* in a lower portion thereof below fluid-suction passage 2*c*. Rear fluid-discharge passage 2*d* is extended forward from discharge port 24*c* of rear changeover valve 24, and is bent rightward at a front end thereof (not shown) so as to be connected to rear outlet port Po. Front fluid-discharge passage 2*d* is extended rearward from discharge port 25*c* of front changeover valve 25, and is bent rightward at a rear end thereof (not shown) so as to be connected to front outlet port Po.

In this way, discharge ports 24*c* and 25*c* of respective changeover valves 24 and 25 are fluidly connected to fluid sump 3*b* via respective fluid-discharge passages 2*d*, respective outlet ports Po and respective return ports Pr.

Incidentally, in the hydraulic circuit diagram of FIG. 11, fluid-discharge passage 2*d* from discharge port 24*c* and fluid-discharge passage 2*d* from discharge port 25*c* are illustrated as being joined to each other so that the joined fluid-discharge passage 2*d* is fluidly connected to fluid sump 3*b* via single outlet port Po and single return port Pr. Therefore, alternatively, supporter 11 may be provided with sole return port Pr, servo housing 20 may be provided with sole outlet port Po, and servo housing 20 may be formed with fluid-discharge passages 2*d* from respective discharge ports 24*c* and 25*c* joined to each other and then connected to outlet port Po.

Changeover valves 24 and 25 are electromagnetic proportional control valves provided with respective proportional solenoids 24*a* and 25*a*. Proportional solenoids 24*a* and 25*a* project downward from a bottom surface of servo housing 20.

Each of changeover valves 24 and 25 is basically configured so as to supply fluid to corresponding hydraulic fluid chamber 2*a* or 2*b* by exciting corresponding proportional solenoid 24*a* or 25*a*. In this embodiment, rear changeover valve 24 supplies hydraulic fluid to rear hydraulic fluid chamber 2*a* according to excitation of its proportional solenoid 24*a*, and front changeover valve 25 supplies hydraulic fluid to front hydraulic fluid chamber 2*b* according to excitation of its proportional solenoid 25*a*.

Each of proportional solenoids 24*a* and 25*a* generates a drive power in proportion to its control current value (a value of electric current applied to each proportional solenoid 24*a* or 25*a*). In other words, hydraulic fluid flow to each of hydraulic fluid chambers 2*a* and 2*b* is controlled in amount and pressure in correspondence to the value of control current, thereby minutely controlling an axial (fore-and-aft) position of piston 22 so as to minutely (steplessly) control a tilt angle of movable swash plate 6.

A controller (not shown) controls the control current value in correspondence to an operation degree of the above-mentioned manipulator manipulated by an operator. Electric current having the value controlled in this manner is applied to each proportional solenoid 24*a* or 25*a*. Each of changeover valves 24 and 25 is configured so that it is vibratorily switched between a supply position and a discharge position in correspondence to the control current value applied thereto. Each of changeover valves 24 and 25, when located at its supply position, fluidly connects corresponding suction port 24*b* or 25*b* to corresponding suction/discharge port 24*d* or 25*d* so as to supply corresponding hydraulic fluid chamber 2*a* or 2*b* with hydraulic fluid introduced into corresponding suction port 24*b* or 25*b*.

When changeover valve 24 is disposed at its supply position, suction port 24*b* is fluidly connected to suction/discharge port 24*d* so that fluid introduced into suction port 24*b* is supplied to hydraulic fluid chamber 2*a*. Meanwhile, changeover valve 25 is disposed at its discharge position so as to fluidly connect suction/discharge port 25*d* to discharge port 25*c*, so that fluid introduced from hydraulic fluid chamber 2*b* to suction/discharge port 25*d* is discharged to fluid sump 3*b* in housing 3 via fluid-discharge passage 2*d*, outlet port Po, and return port Pr.

When changeover valve 25 is disposed at its supply position, suction port 25*b* is fluidly connected to suction/discharge port 25*d* so that fluid introduced into suction port 25*b* is supplied to hydraulic fluid chamber 2*b*. Meanwhile, changeover valve 24 is disposed at its discharge position so as to fluidly connect suction/discharge port 24*d* to discharge port 24*c*, so that fluid introduced from hydraulic fluid chamber 2*a* to suction/discharge port 24*d* is discharged to fluid sump 3*b* in housing 3 via fluid-discharge passage 2*d*, outlet port Po, and return port Pr.

Such fluid supply and discharge are repeated so as to set a pressure in each of hydraulic fluid chambers 2*a* and 2*b*. Therefore, piston 22 moves until it reaches a position where the pressure is balanced with the biasing force of spring 23.

When the pressure in hydraulic fluid chamber 2*a* is increased by exciting proportional solenoid 24*a*, piston 22 moves forward (leftward in FIG. 9) against the elastic force of spring 23. Rear spring retainer 32 and stopper collar 33 also move forward together with piston 22. Meanwhile, front spring retainer 34 does not move forward because it is retained by stopper ring 36. As a result, a distance between front and rear spring retainers 32 and 34 is reduced to gradually increase a compression degree of spring 23.

In correspondence to the forward movement of piston 22, key member 64, arm 63 and trunnion shaft portions 6*a* and 6*b* rotate in a normal direction from their neutral position (see FIG. 5) in hydraulic pump 1. The controller receives a feedback signal from angle sensor 12*c*. When a difference between an actual tilt angle of movable swash plate 6 and a target tilt angle of movable swash plate 6 corresponding to the operational degree (or operational position) of the manipulator reaches zero, the controller recognizes it as arrival of movable swash plate 6 at the target tilt angle position, and no further outputs a signal for exciting proportional solenoid 24*a*.

The forward movement of piston 22 is limited so that piston 22 can move forward until stopper collar 33 pushed by rear spring retainer 32 comes to contact front spring retainer 34 so as to be sandwiched between rear and front spring retainers 32 and 34. The forward movement range of piston 22 from the neutral position to the limit position coincides to a range of tilt angle of trunnion shaft portion 6*a* in the normal direction from zero degree to a positive half of tilt angle T (see FIG. 5).

After piston 22 is moved forward from the neutral position, if proportional solenoid 24*a* is unexcited, the pressure in hydraulic fluid chamber 2*a* is reduced and piston 22 moves rearward (rightward in FIG. 9) by the restoring (elastic) force of compressed spring 23 until the pressures in respective hydraulic fluid chambers 2*a* and 2*b* become equal to each other. Rear spring retainer 32 also moves rearward together with piston 22 until it comes to be retained by flange portion 30*a*. In correspondence to the rearward movement of piston 22, key member 64, arm 63 and trunnion shaft portions 6*a* and 6*b* rotate to reduce the tilt angle of movable swash plate 6 until they reach the neutral position (see FIG. 5).

On the other hand, when the pressure in hydraulic fluid chamber 2*b* is increased by exciting proportional solenoid 25*a*, piston 22 and front spring retainer 34 move rearward (rightward in FIG. 9) against the elastic force of spring 23. Meanwhile, rear spring retainer 32 does not move rearward because it is retained by flange portion 30*a* of guide rod 30. As a result, a distance between rear and front spring retainers 32 and 34 is reduced to gradually increase a compression degree of spring 23.

In correspondence to the rearward movement of piston 22, key member 64, arm 63 and trunnion shaft portions 6*a* and 6*b* rotate in a reverse direction from their neutral position (see FIG. 5) in hydraulic pump 1. The controller receives a feedback signal from angle sensor 12*c*. When a difference between an actual tilt angle of movable swash plate 6 and a target tilt angle of movable swash plate 6 corresponding to the operational degree of the manipulator reaches zero, the controller recognizes it as arrival of movable swash plate 6 at the target tilt angle position, and no further outputs a signal for exciting proportional solenoid 25*a*.

The rearward movement of piston 22 is limited so that piston 22 can move rearward until topper collar 33 comes to contact front spring retainer 34, i.e., stopper collar 33 comes to be sandwiched between rear and front spring retainers 32 and 34. The rearward movement range of piston 22 from the neutral position to the limit position coincides to a range of tilt angle of trunnion shaft portion 6*a* in the reverse direction from zero degree to a negative half of tilt angle T (see FIG. 5).

After piston 22 is moved rearward from the neutral position, if proportional solenoid 25*a* is unexcited, the pressure in hydraulic fluid chamber 2*b* is reduced and piston 22 moves forward by the restoring (elastic) force of compressed spring 23 until the pressures in respective hydraulic fluid chambers 2*a* and 2*b* become equal to each other. Front spring retainer 34 also moves forward together with piston 22 until it comes to be retained by stopper ring 36. In correspondence to the forward movement of piston 22, key member 64, arm 63 and trunnion shaft portions 6*a* and 6*b* rotate to reduce the tilt angle of movable swash plate 6 until they reach the neutral position (see FIG. 5).

A fluid charge system for supplementing hydraulic fluid to the closed fluid circuit of hydraulic pump 1 will be described with reference to FIGS. 10 and 11 and others.

Figure 10:
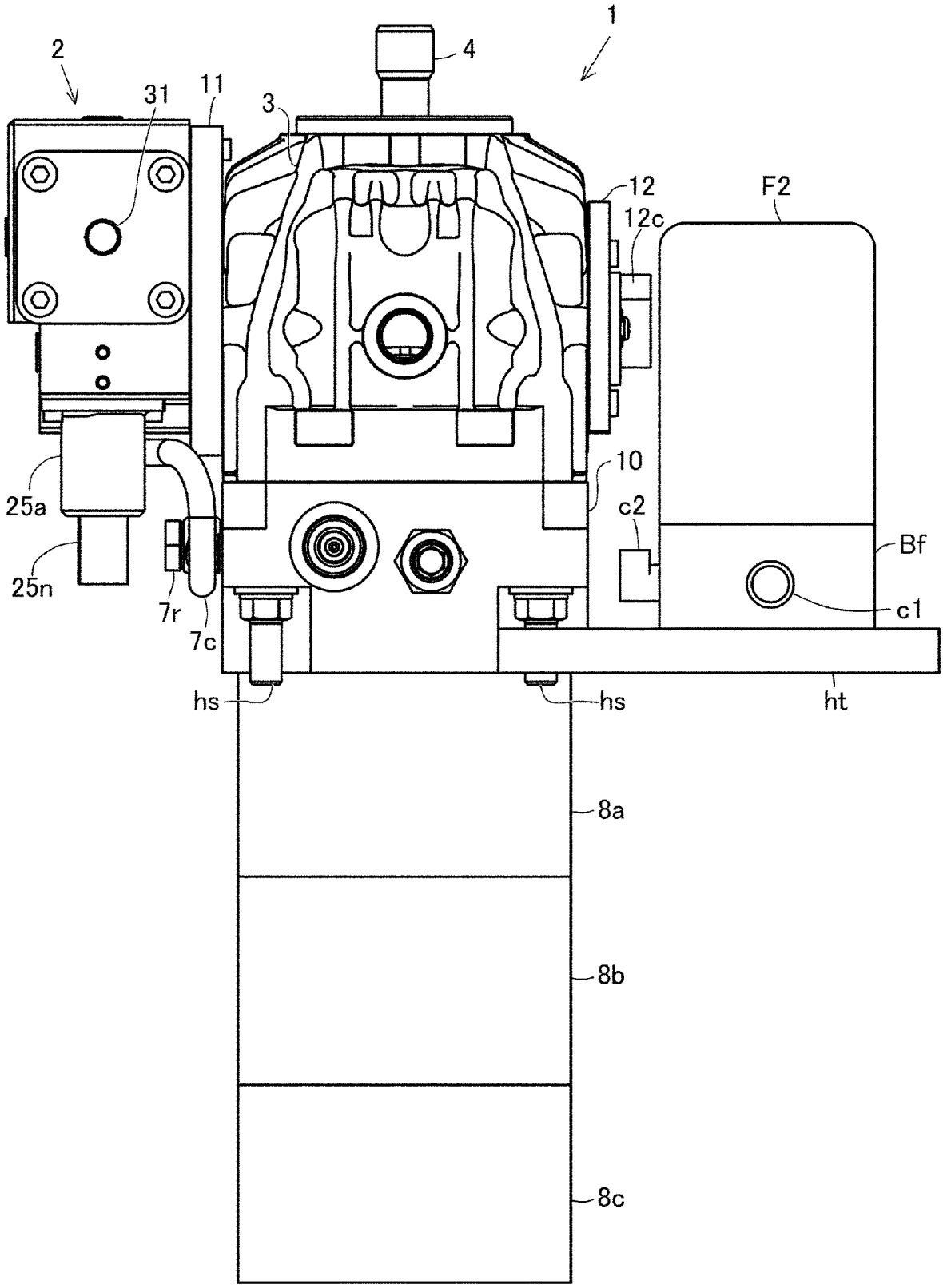
FIG. 10 is a front view of the hydraulic pump to which the servo unit, a line filter, and external pumps are attached.

Referring to FIG. 10, port block 10 is provided therebelow with at least one external pump, e.g., three external pumps 8*a*, 8*b* and 8*c* as provided in this embodiment. External pumps 8*a*, 8*b* and 8*c* are not limited in location and in order. Regarding the embodiment of FIG. 10, external pumps 8*a*, 8*b* and 8*c* are aligned in this order along the direction away from hydraulic pump 1 (in this embodiment, downward). In other words, in this embodiment, external pump 8*b* is disposed below external pump 8*a*, and external pump 8*c* below external pump 8*b*, continuously.

Triple external pumps 8*a*, 8*b* and 8*c* are gear pumps, for example, and are drivingly connected to bottom end 4*b* of drive shaft 4 (see FIG. 7). Therefore, external pumps 8*a*, 8*b* and 8*c* receive a rotary power via drive shaft 4 from a later-discussed prime mover E, e.g., an engine, thereby activating as pumps. Especially, external pumps 8*b* and 8*c* serve as charge pumps for supplying hydraulic fluid to hydraulic pump 1 and servo unit 2 (see FIG. 11).

Line filter F2 is disposed sideward from hydraulic pump 1 so as to filter hydraulic fluid before the fluid is introduced to the inside of hydraulic pump 1. Line filter F2 is fixed to a filter mounting table ht so as to be located to face gauge port Pc (see FIG. 8) of hydraulic pump 1. Table ht is supported by two of four feet hs provided on the bottom surface of port block 10.

In other words, of four feet hs, two right feet hs support table ht so that table ht is extended rightward from the right bottom portion of port block 10 to the right side of hydraulic pump 1. Line filter F2 mounted on table ht is disposed rightward from housing 3 of hydraulic pump 1 laterally opposite servo unit 2 with respect to housing 3 so as to face gauge port Pc open at the right side surface of port block 10.

More specifically, line filter F2 includes port block Bf. A pipe joint c1 serving as an inlet port is provided on one side surface of port block Bf. A pipe joint c2 serving as an outlet port is provided on another side surface of port block Bf. Port block Bf of line filter F2 is mounted on table ht so that pipe joint c2 is disposed at the left side surface of port block Bf so as to face gauge port Pc open at the right side surface of port block 10.

A hydraulic fluid supply system for supplying hydraulic fluid to hydraulic pump 1, servo unit 2, and a hydraulic motor M will now be described with reference to FIG. 11.

A vehicle equipped with the HST is also equipped with an external tank Rt. Hydraulic fluid is sucked to external pumps 8*a*, 8*b* and 8*c* via a fluid passage L1 constituted by a pipe, e.g., a hose. Line filter F1 is provided on fluid passage L1. Therefore, the hydraulic fluid from tank Rt is filtered by line filter F1, and then is sucked to external pumps 8*a*, 8*b* and 8*c*.

The vehicle is equipped with prime mover E, e.g., an engine, for driving drive shaft 4 of hydraulic pump 1. The vehicle is also equipped with a hydraulic steering unit 9*b* (including a power steering unit, for example) for right and left turning of the vehicle. Further, in this embodiment, the vehicle equipped with the HST including hydraulic pump 1 is a mower tractor (i.e., a riding mower) equipped with a reel mower unit. Therefore, the vehicle is provided with a hydraulic lift device for vertically moving the reel mower unit, and with a hydraulic device for controlling an activation degree of a reel or reels of the reel mower unit.

The vehicle is equipped with a lift control valve 9*a* for controlling hydraulic fluid supply to the hydraulic lift device, and with a reel control valve 9*c* for controlling hydraulic fluid supply to the hydraulic device for controlling the reel or reels.

Fluid delivered from external pump 8*a* is supplied to reel control valve 9*c*. Fluid discharged from reel control valve 9*c* is returned to tank Rt via a fluid-drain passage L3.

Fluid delivered from external pump 8*b* is supplied to steering unit 9*b* including hydraulic devices, e.g., a valve and a steering actuator, so as to activate the hydraulic devices in steering unit 9*b*. Fluid delivered from external pump 8*c* is supplied to lift control valve 9*a*.

Fluid discharged from steering unit 9*b* and lift control valve 9*a* is joined together and is introduced into gauge port Pc of port block 10 via fluid passage L2. As discussed later, the fluid introduced into gauge port Pc is supplied as hydraulic fluid for the HST to the closed fluid circuit serving as the HST, and is supplied as hydraulic fluid for controlling piston 22 for controlling the fluid delivery amount and direction of hydraulic pump 1 to servo unit 2.

Alternatively, fluid delivered from two or all of external pumps 8*a*, 8*b* and 8*c* may be joined together to be supplied to any one of reel control valve 9*c*, steering unit 9*b* or lift control valve 9*a*. Alternatively, fluid delivered from any one of external pumps 8*a*, 8*b* and 8*c* may be branched to two or all of reel control valve 9*c*, steering unit 9*b* and lift control valve 9*a*.

Line filter F2 is provided on fluid passage L2. In other words, fluid passage L2 includes an upstream portion between lift control valve 9*a* and steering unit 9*b* and an inlet port of lie filter F2, and a downstream portion between an outlet port of line filter F2 and gauge port Pc.

A fluid pipe, e.g., a hose, is extended from lift control valve 9*a* and steering unit 9*b*, and is connected to pipe joint c1 provided on port block Bf of line filter F2, thereby serving as the upstream portion of fluid passage L2. On the other hand, another fluid pipe, e.g., a hose, is interposed between pipe joint c2 on port block Bf of line filter F2 and gauge port Pc in port block 10 of hydraulic pump 1, thereby serving as the downstream portion of fluid passage L2.

Hydraulic fluid filtered by line filter F2 is introduced to fluid-charge passage Lc via gauge port Pc. Charge relief valve 26 regulates a pressure in fluid-charge passage Lc. Charge relief valve 26 discharges excessive hydraulic fluid from fluid-charge passage Lc to fluid sump 3*b* in housing 3 via fluid-drain passage Ld. Fluid sump 3*b* is fluidly connected to external tank Rt via fluid passage L5 having a fluid cooler G1 thereon.

A pair of main fluid passages ML1 and ML2 are interposed between hydraulic pump 1 and hydraulic motor M. Main fluid passage ML1 between hydraulic pump 1 and hydraulic motor M includes a part between kidney port M1*a* and main port Pe. The part of main fluid passage ML1 between kidney port M1*a* and main port Pe corresponds to the above-mentioned main fluid passage ML1 in port block 10. Main fluid passage ML2 between hydraulic pump 1 and hydraulic motor M includes a part between kidney port M2*a* and main port Pb. The part of main fluid passage ML1 between kidney port M2*a* and main port Pb corresponds to the above-mentioned main fluid passage ML2 in port block 10. Hydraulic motor M includes a left motor LM drivingly connected to a left traveling device, e.g., a left drive wheel, of the vehicle and a right motor RM drivingly connected to a right traveling device, e.g., a right drive wheel, of the vehicle.

A pair of charge valve units CV1 and CV2 are interposed between main fluid passages ML1 and ML2 in port block 10. Charge valve unit CV1 includes a check valve 271 and a relief valve 281. Charge valve unit CV1 includes a check valve 272, a relief valve 282 and a neutral valve 283.

Hydraulic fluid having a pressure regulated by charge relief valve 26 is supplied to main fluid passage ML1 by opening check valve 271 in charge valve unit CV1, or is supplied to main fluid passage ML2 by opening check valve 281 in charge valve unit CV2.

Which main fluid passage ML1 or ML2 is higher-pressurized (or lower-pressurized) depends on in which direction movable swash plate 6 is tilted from the neutral position. When the pressure in lower-pressurized main fluid passage ML1 or ML2 becomes lower than the pressure in fluid-charge passage Lc regulated by charge relief valve 26, check valve 271 or 272 of corresponding charge valve unit CV1 or CV2 is opened to supply hydraulic fluid to the lower-pressurized main fluid passage ML1 or ML2.

Relief valves 281 and 282 are provided in respective charge valve units CV1 and CV2 so as to bypass respective check valves 271 and 272. When the pressure in higher-pressurized main fluid passage ML1 or ML2 exceeds a relief pressure set in corresponding relief valve 281 or 282, corresponding relief valve 281 or 282 returns excessive fluid in higher-pressurized main fluid passage ML1 or ML2 to fluid-charge passage Lc so as to regulate the pressure of hydraulic fluid in higher-pressurized main fluid passage ML1 or ML2.

In charge valve unit CV2, neutral valve (orifice) 283 bypasses check valve 272 and relief valve 282 so as to expand a neutral zone of movable swash plate 6. In correspondence to charge valve unit CV2 including neutral valve 283, main fluid passage ML2 supplied with fluid by opening check valve 272 of charge valve unit CV2 preferably serves as the fluid passage that is higher-pressurized during backward traveling of the vehicle. Therefore, the neutral zone for surely keeping stationary hydraulic motor M from rotating is expanded from the proper neutral position in the tilt direction of movable swash plate 6 for backward traveling of the vehicle.

Alternatively, charge valve unit CV1 for main fluid passage ML1 that is higher-pressurized during forward traveling of the vehicle may include a neutral valve, or both charge valve units CV1 and CV2 may include respective neutral valves.

If the tilt direction of movable swash plate 6 is set to higher-pressurize main fluid passage ML1, hydraulic motor M is supplied with hydraulic fluid via main port Pe, and returns fluid to port block 10 of hydraulic pump 1 via main port Pb. On the other hand, if the tilt direction of movable swash plate 6 is set to higher-pressurize main fluid passage ML2, hydraulic motor M is supplied with hydraulic fluid via main port Pb, and returns fluid to port block 10 of hydraulic pump 1 via main port Pe.

Manually operable bypass valve 29, hydraulic motor M and the pair of charge valve units CV1 and CV2 are fluidly connected to hydraulic pump 1 in parallel to each other. When the vehicle is towed, for example, axles (not shown) of the vehicle drivingly connected to the traveling devices should be rotatably free from a dynamic pressure force of fluid through hydraulic pump 1. In such a case, bypass valve 29 is opened to circulate fluid between hydraulic motor M and bypass valve 29 bypassing hydraulic pump 1, thereby reducing resistance of hydraulic fluid in the closed fluid circuit of the HST against the traveling devices, e.g., drive wheels, during the towing of the vehicle.

Fluid in fluid-charge passage Lc is supplied to the HST including hydraulic pump 1 and hydraulic motor M via check valve 271 or 272 of charge valve unit CV1 or CV2 as mentioned above, and is also supplied to servo unit 2 via servo port Ps of port block 10 and inlet port Pi of servo housing 20.

As mentioned above, outlet ports Po formed in servo housing 20 and return ports Pr formed in supporter 11 are directly joined to each other, respectively. On the other hand, as shown in FIG. 5 and others, hose 7*c* is interposed between pipe joint 7*r* provided at servo port Ps (see FIG. 8) and pipe joint 7*c* provided at inlet port Pi (see FIG. 9) so as to fluidly connect servo port Ps to inlet port Pi.

The hydraulic fluid introduced into servo housing 20 via inlet port Pi is filtered by internal filter F3, and then is supplied to suction ports 24*b* and 25*b* of respective changeover valves 24 and 25. Fluid discharged from fluid-discharge ports 24*c* and 25*c* of respective changeover valves 24 and 25 is drained from outlet ports Po in servo housing 20 to fluid sump 3*b* in housing 3 via return ports Pr in supporter 11.

An alternative embodiment of hydraulic pump 1 provided with a servo unit, a line filter and external pumps will be described with reference to FIGS. 12 to 15, and a hydraulic circuit structure of FIG. 16 including hydraulic pump 1 as shown in FIGS. 12 to 15 will be described with reference to FIG. 16. Members and portions identical in structure or function to those in the above-mentioned embodiment shown in FIGS. 10 and 11 are designated by reference numerals that are the same as those in the above-mentioned embodiment. Therefore, description of these members and portions will be omitted unless any one of them has to be specified.

Regarding line filter F2 shown in FIGS. 10 and 11, as mentioned above, it includes port block Bf attached to table ht extended from port block 10 of hydraulic pump 1. External pipe joint c2 serving as an outlet port is provided on port block Bf so that an external fluid pipe, e.g., a hose, is interposed between pipe joint c2 and gauge port Pc open at the side surface of port block 10 of hydraulic pump 1 facing line filter F2 so as to serve as the portion of fluid passage L2 downstream of line filter F2.

On the contrary, regarding line filter F2 attached to hydraulic pump 1 as shown in FIGS. 12 to 16, it includes a port block 50 corresponding to table ht and port block Bf integrated with each other. A side surface of port block 50 is joined to the side surface of port block 10 of hydraulic pump 1. An end of a later-discussed outlet side fluid passage 50*e* in port block 50 is open at the side surface of port block 50 joined to port block 10 so as to serve as an outlet port 50*f* of line filter F2, which is directly joined to gauge port Pc open at the side surface of port block 10.

Therefore, the embodiment of FIGS. 12 to 16 needs neither the external fluid pipe (the portion of fluid passage L2 downstream of line filter F2 as shown in FIG. 11) required for the embodiment of FIGS. 10 and 11 to connect gauge port Pc to the outlet port of line filter F2, nor pipe joint c2 required for the embodiment of FIGS. 10 and 11 to be provided at the outlet port of line filter F2 so as to connect the external fluid pipe to the outlet port.

According to the embodiment of FIGS. 12 to 16, outlet port 50*f* of line filter F2 is directly joined to gauge port Pc of port block 10 only if the side surface of port block 50 of line filter F2 abuts against the side surface of pot block 10 of hydraulic pump 1, thereby facilitating construction of a fluid passage from line filter F2 to charge valve units CV1 and CV2 in port block 10, and thereby shortening this fluid passage so as to minimize hydraulic pump 1 provided with line filter F2.

Incidentally, in this embodiment, a collar 55 is provided inside of port blocks 10 and 50 so as to extend between outlet port 50*f* and gauge port Pc through the side surfaces of port blocks 10 and 50 joined to each other, thereby preventing fluid from leaking out from a gap between ports 50*f* and Pc.

A fluid passage structure in port block 50 and line filter F2 mounted on port block 50 will be described in detail. Line filter F2 includes a circular cylindrical filter casing 51, a main filter body 52 and a delivery port member 53. Filter casing 51 incorporating main filter body 52 and delivery port member 53 is mounted onto a surface of port block 50 serving as a filter-mounting surface.

In this embodiment, a bottom plane surface of port block 50 serves as the filter-mounting surface, similar to the bottom plane surface of port block 10 onto which external pumps 8*a*, 8*b* and 8*c* are mounted so as to extend downward therefrom. Therefore, filter casing 51 mounted to the filter-mounting surface of port block 50 is extended downward from port block 50 and parallel to external pumps 8*a*, 8*b* and 8*c*.

If port block 50 located to have its upper surface serving as the filter-mounting surface is joined to port block 10, line filter F2 can be mounted onto the filter-mounting surface of port block 50 so as to extend upward therefrom and parallel to housing 3 of hydraulic pump 1.

The filter-mounting surface of port block 50 (i.e., the bottom plane surface of port block 50 in this embodiment) is formed thereon with an annular groove serving as suction port 50*c* for introducing fluid into filter casing 51. Pipe joint c1 is fitted into an inlet port 50*a* that is open at a surface (i.e., the top plane surface of port block 50 in this embodiment) of port block 50 opposite the filter-mounting surface. In this embodiment, a vertical inlet side fluid passage 50*b* is bored in port block 50 so as to connect inlet port 50*a* to suction port 50*c*.

Regarding the embodiment of FIG. 10, the top plane surface of port block Bf to which line filter F2 is mounted is perpendicular to the side surface of port block Bf having the inlet port into which pipe joint c1 is fitted. Therefore, port block Bf has to be formed with a complicated fluid passage, such as an L-shaped passage, to connect the inlet port to a suction port for introducing fluid into line filter F2.

Regarding the present embodiment, in comparison with the embodiment of FIG. 10, one (the top plane surface) of opposite surfaces of port block 50 is provided with inlet port 50*a*, and the other (the bottom plane surface) of the opposite surfaces of port block 50 with suction port 50*c*, so that inlet side fluid passage 50*b* formed in port block 50 to connect inlet port 50*a* to suction port 50*c* is an extremely shortened straight fluid hole extended in the thickness (in this embodiment, vertical) direction of port block 50.

Therefore, the loss in amount and pressure of fluid during its flow through inlet side fluid passage 50*b* is reduced so as to enhance the filtering efficiency of line filter F2, and so as to reduce manufacturing processes for forming inlet side passage 50*b*, thereby reducing costs.

Circular columnar main filter body 52 is disposed in filter casing 51 so that fluid flowing from suction port 50*c* into filter casing 51 enters main filter body 52.

A delivery port 50*d* is formed in port block 50 so as to be open at the filter-mounting (in this embodiment, bottom plane) surface of port block 50 surrounded by suction pot 50*c*. Delivery port member 53 of line filter F2 is fitted into delivery port 50*d* so as to face a central portion of main filter body 52 formed as a delivery port portion of main filter body 52.

Figure 13:
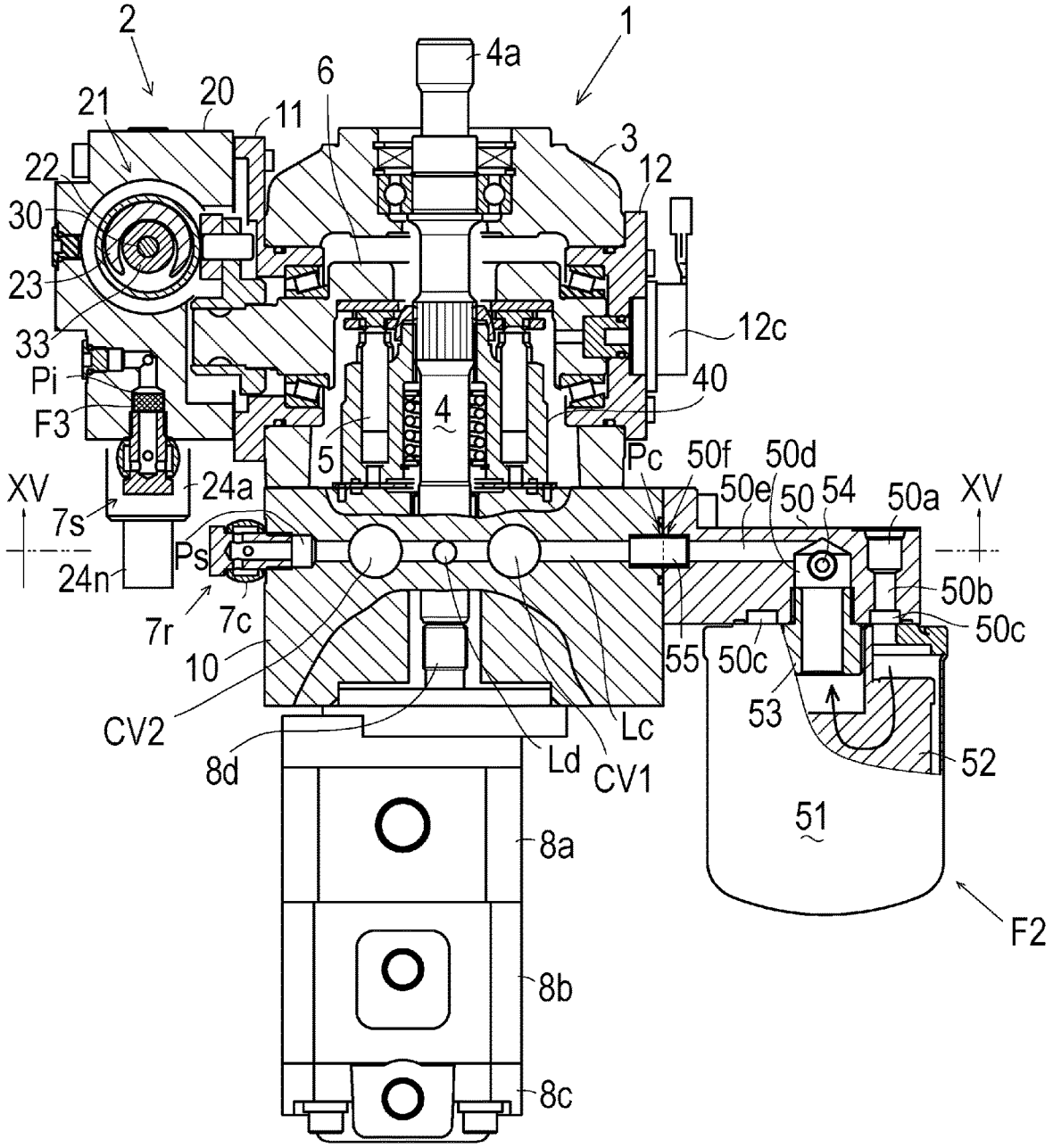
FIG. 13 is a cross sectional view taken along XIII-XIII line of FIG. 12.
Figure 14:
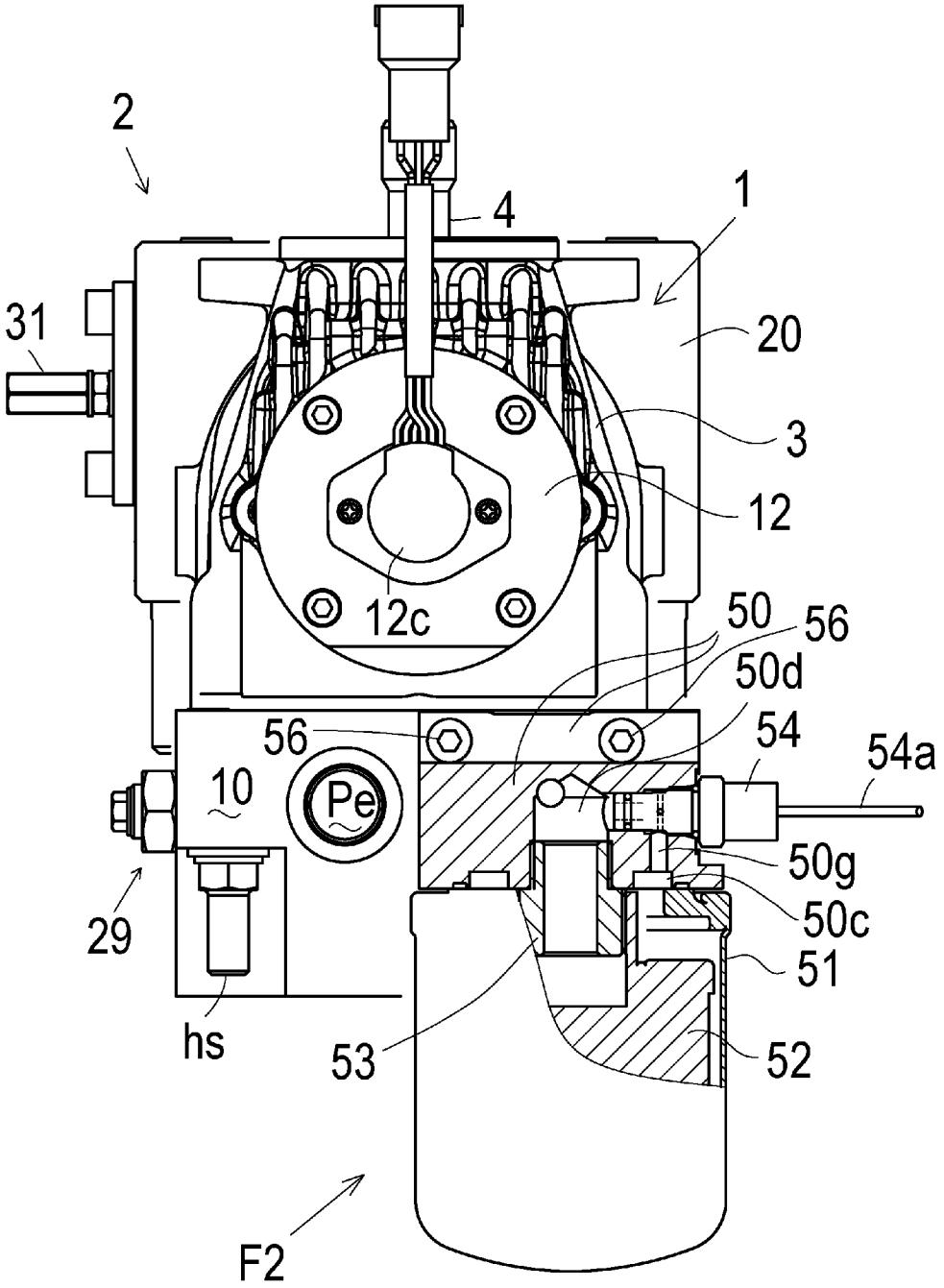
FIG. 14 is a cross sectional view taken along XIX-XIX line of FIG. 12.
Figure 15:
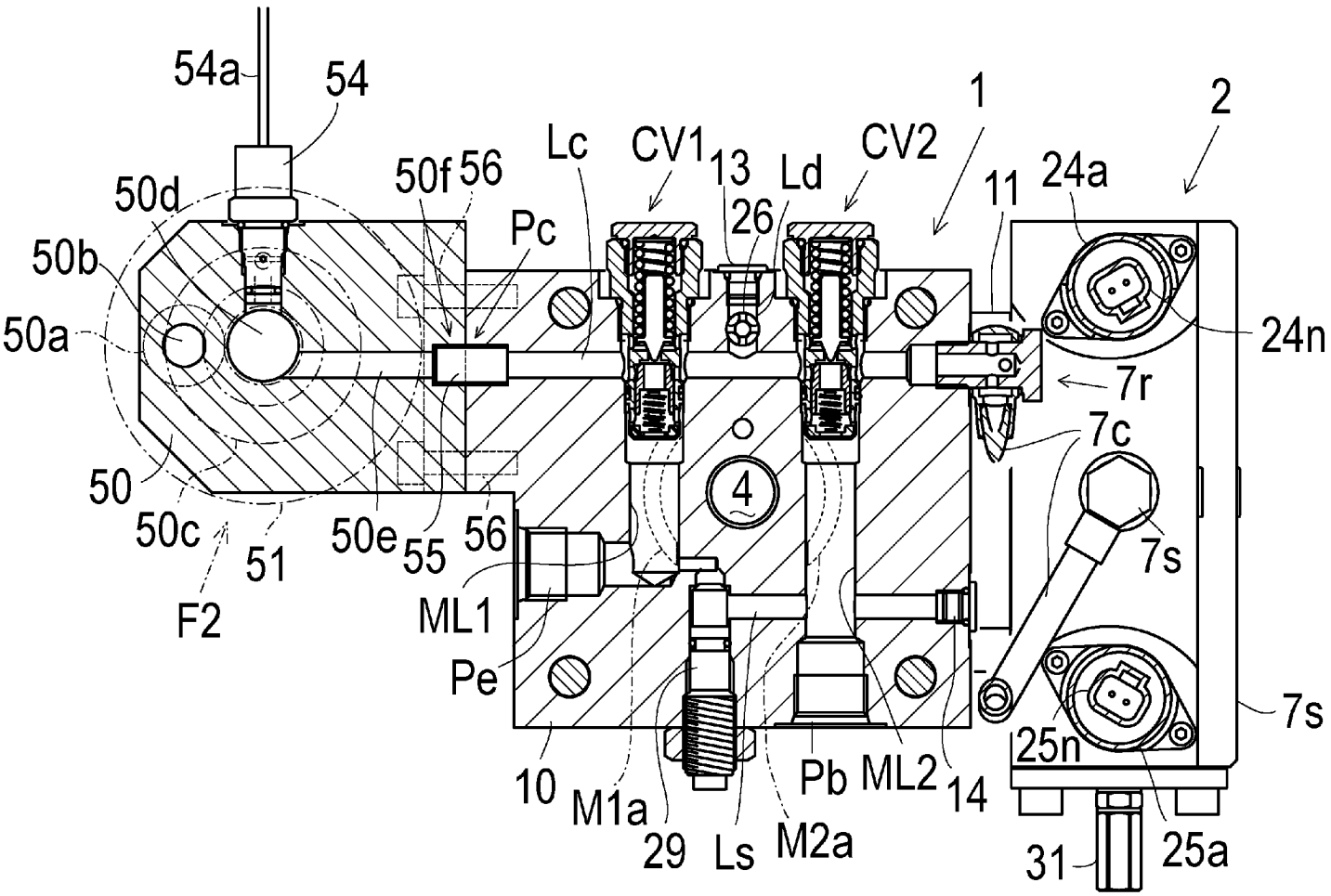
FIG. 15 is a cross sectional view taken along XV-XV line of FIG. 13.

Therefore, fluid flowing from suction port 50*c* into filter casing 51 is filtered during its flowing through main filter body 52 as indicated by the arrow in FIG. 13, and then is delivered to delivery port 50*d* in port block 50 via delivery port member 53.

Straight outlet side fluid passage 50*e* is bored in port block 50 from delivery port 50*d* to outlet port 50*f*. When outlet port 50*f* is joined to gauge port Pc of port block 10 as mentioned above, outlet side fluid passage 50*e* is extended coaxially to fluid-charge passage Lc in port block 10.

Therefore, a straight fluid passage is formed from delivery port 50*d* to fluid-charge passage Lc so as to reduce losses in amount and pressure of fluid during its flow through this fluid passage, thereby ensuring proper activation of charge valve units CV1 and CV2. Further, the portion of port block 50 around outlet side fluid passage 50*d* is minimized so as to reduce manufacturing processes for forming it, thereby reducing costs.

Incidentally, a filter-clogging detection switch 54 is disposed in port block 50 so as to face delivery port 50*d*. A fluid passage 50*g* is extended from switch 54 to suction port 50*c*. Therefore, switch 54 is fluidly connected to both an upstream side of main filter body 52 (i.e., suction port 50*c*) and a downstream side of main filter body 52 (i.e., delivery port 50*d*) so as to detect a differential hydraulic pressure between the upstream side and the downstream side, so that switch 54 is turned on or off depending on whether the differential hydraulic pressure exceeds a threshold or not.

In this regard, when main filter body 52 is clogged, a pressure of fluid flowing out from main filter body 52 to delivery port 50*d* at the downstream side of main filter body 52 is reduced. If the pressure reduction degree is increased so that the differential hydraulic pressure between the upstream and downstream sides of main filter body 52 exceeds a certain value (i.e., the threshold), switch 54 is switched (for example, switch 54 having been turned off is turned on) so as to make line filter F2 recognized as requiring exchange for new line filter F2 (or new main filter body 52).

The switching of switch 54 is transmitted to an alarm (not shown) via an electric wire 54*a* extended from switch 54 so that the alarm gives an operator a caution for exchange of the filter. For example, the alarm is a visual indication on a display provided on a dashboard of the vehicle.

As mentioned above, to be joined to port block 10, port block 50 may be vertically reversed so as to have the filter-mounting surface facing upward, i.e., so as to extend line filter F2 upward therefrom, and so as to have inlet port 50*a* (pipe joint c1) facing downward.

Figure 16:
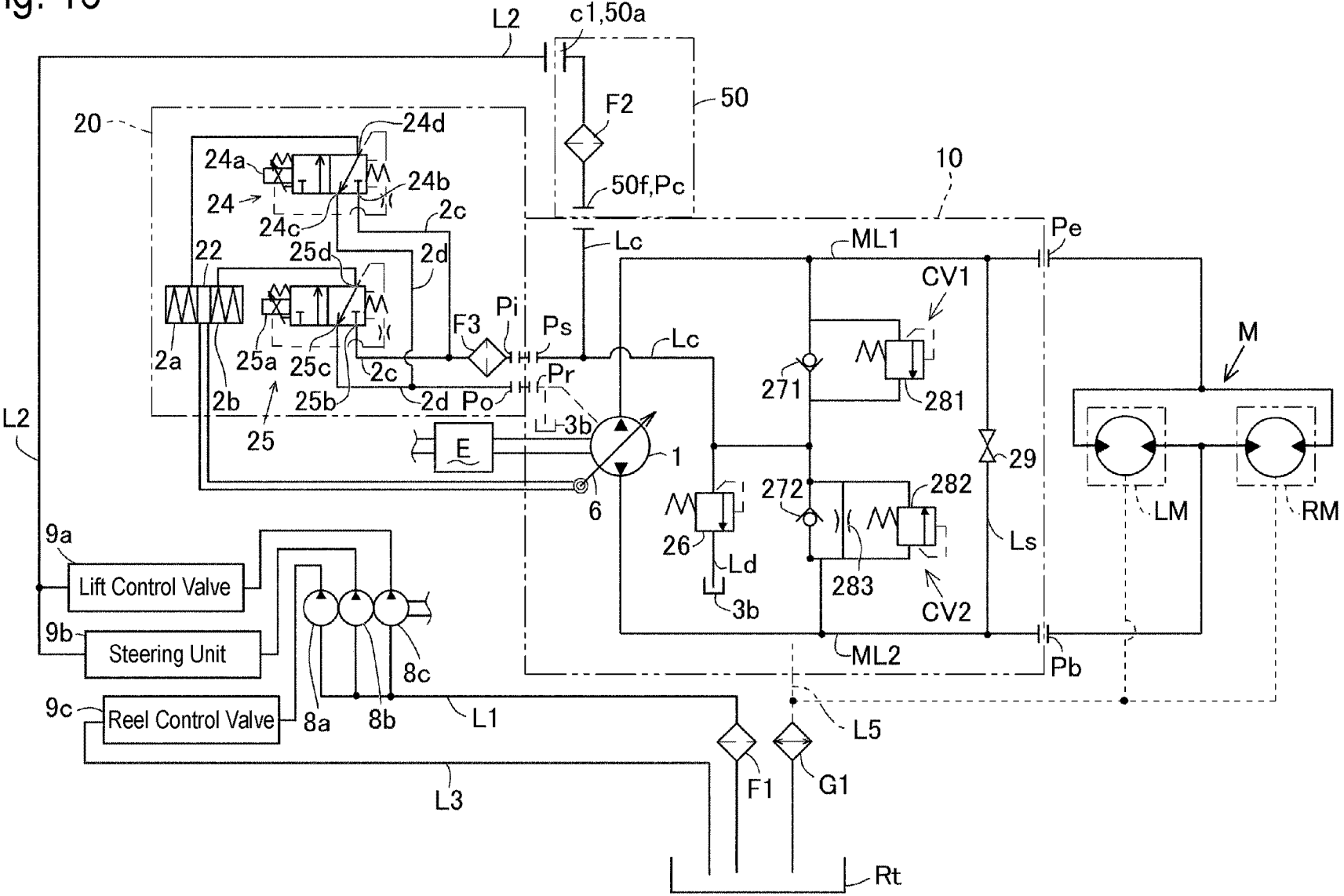
FIG. 16 is a circuit diagram of a hydraulic fluid supply system for an HST including the hydraulic pump and the servo unit as shown in FIGS. 12 to 15.

Environments surrounding hydraulic pump 1 or piping of fluid pipes serving as fluid passage L2 connected to pipe joint c1 fitted into inlet port 50*a* as shown in FIG. 16 can be considered for selecting whether line filter F2 is extended upward or downward before port block 50 is attached to port block 10.

Further, port block 50 is fastened to port block 10 by bolts 56. By loosening bolts 56, port block 50 can be detached from port block 10. Therefore, for example, even if port block 50 having line filter F2 extended upward is joined to port block 10, it can be detached from port block 10 to be rearranged to have line filter F2 extended downward, and port block 50 having line filter F2 extended downward can be reattached to port block 10.

Incidentally, a shaft designated by a reference numeral "8*d*" is illustrated in FIG. 13 as being disposed in port block 10 coaxially to pump shaft 4. This shaft is a pump drive shaft 8*d* for driving external pumps 8*a*, 8*b* and 8*c* together. Pump drive shaft 8*d* is connected to pump shaft 4 of hydraulic pump 1 rotatably integrally with pump shaft 4. Pump drive shaft 8*d* is also provided in the embodiment of FIG. 10 although it does not appear in FIG. 10.

A hydraulic transaxle system 100 will be described with reference to FIGS. 17, 18 and 19.

Hydraulic transaxle system 100 is adapted to a zero-turn vehicle configured so as to be able to turn by differential rotation of left and right drive wheels. Especially, the vehicle is able to turn sharply by rotating the left and right drive wheels in opposite directions, or to turn by rotating one drive wheel while keeping the other drive wheel stationary, i.e., to zero-turn.

Hydraulic transaxle system 100 includes a tank R2, a pair of left and right transaxles LA and RA, and a pair of left and right servo units LB and RB. Left and right transaxles LA and RA include respective transaxle casings LAa and RAa each of which incorporates a hydraulic pump Pm and a hydraulic motor M2. Tank R2 is spanned between upper portions of left and right transaxle casings LAa and RAa.

Transaxle casing LAa of left transaxle LA journals a left axle Lx. A left end portion of left axle Lx projects leftwardly outward from a left end of transaxle casing LAa so as to be drivingly connected to a left drive wheel of a vehicle. Transaxle casing RAa of right transaxle RA journals a right axle Rx. A right end portion of right axle Rx projects rightwardly outward from a right end of transaxle casing RAa so as to be drivingly connected to a right drive wheel of the vehicle.

In each of transaxles LA and RA, an HST including hydraulic pump Pm and hydraulic motor M2 is configured so as to circulate hydraulic fluid between hydraulic pump Pm and hydraulic motor M2. Axles Lx and Rx of respective transaxles LA and RA are driven by respective hydraulic motors M2 independently of each other.

Figure 18:
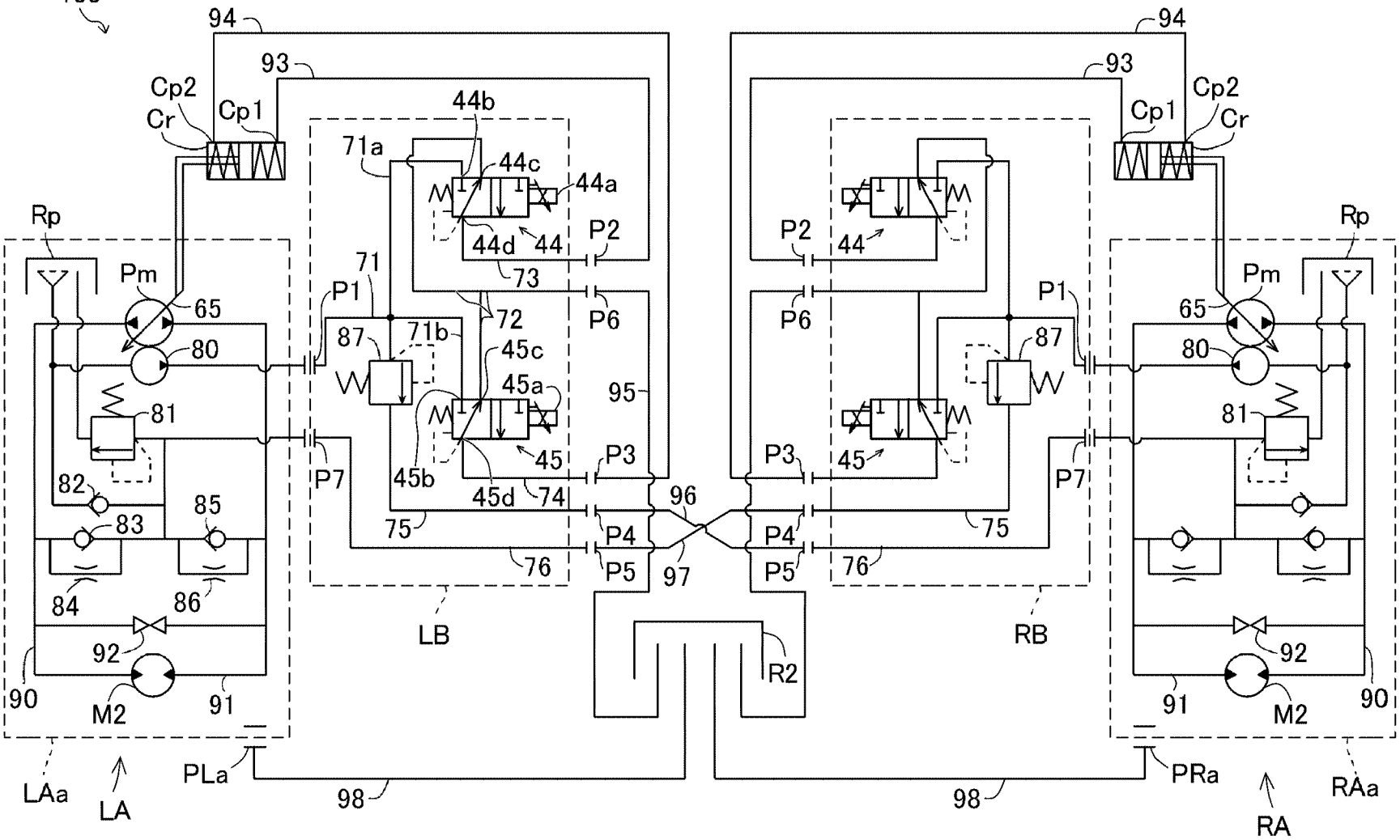
FIG. 18 is a circuit diagram of a hydraulic fluid supply system for the hydraulic transaxle system of FIG. 17.

Referring to FIG. 18, in each of transaxles LA and RA, main fluid passages 90 and 91 are interposed between hydraulic pump Pm and hydraulic motor M2. Therefore, each HST includes hydraulic pump Pm, hydraulic motor M2 and main fluid passages 90 and 91.

Figure 17:
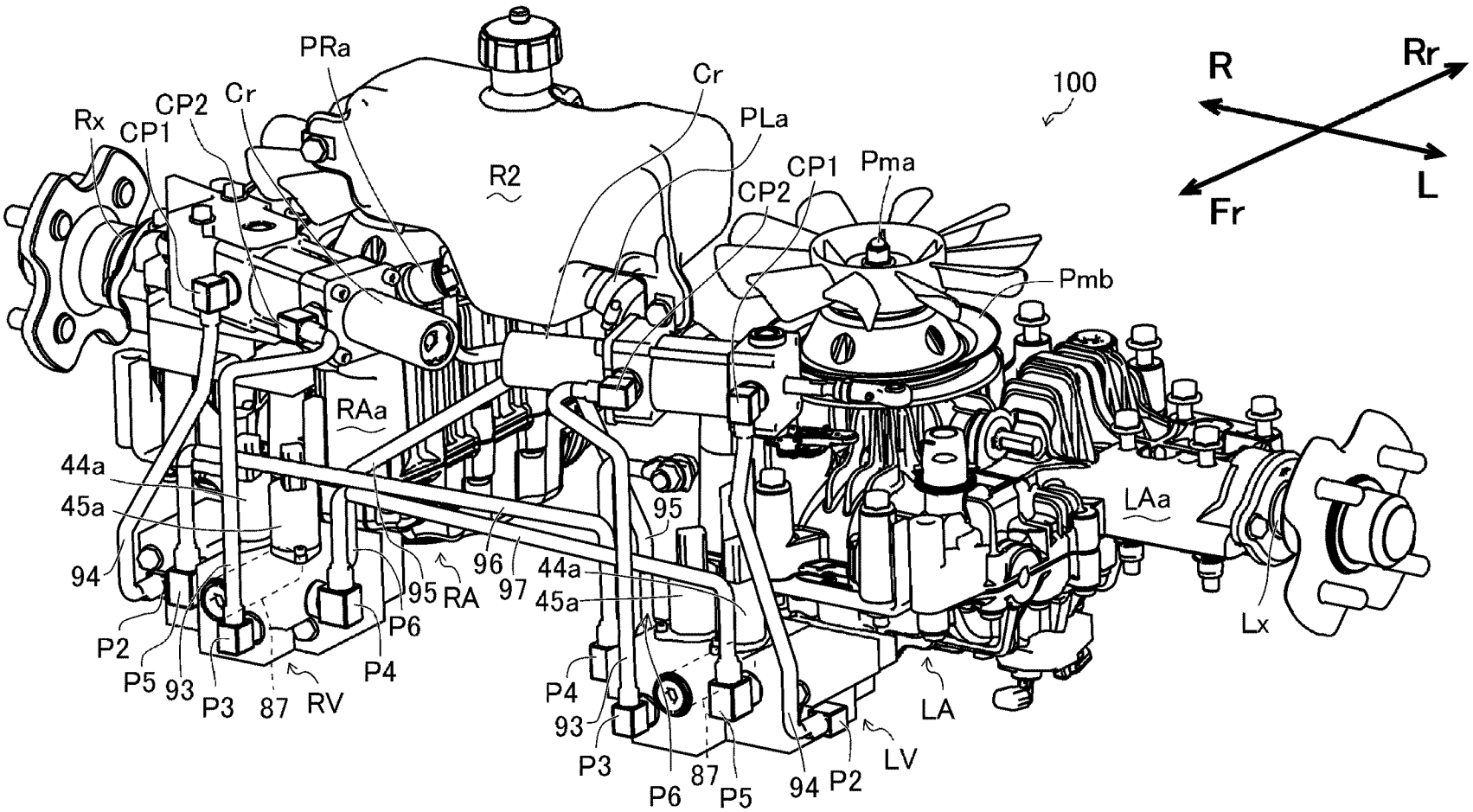
FIG. 17 is a perspective view of a pair of hydraulic transaxles constituting a hydraulic transaxle system for a zero-turn vehicle.

Referring to FIG. 17, each hydraulic pump Pm includes a vertical pump shaft Pma and a movable swash plate 65. Incidentally, only pump shaft Pma of left transaxle LA appears in FIG. 17, where pump shaft Pma of right transaxle RA is hidden behind tank R2. Each of servo mechanisms LB and RB controls tilt direction and angle of corresponding movable swash plate 65, as discussed later.

Top portions of pump shafts Pma of respective left and right transaxles LA and RA project upward from respective transaxle casings LAa and RAa so as to have respective pulleys Pmb fixed thereon. Left and right pump shafts Pma receive power from a prime mover, e.g., an engine, via a belt looped over pulleys Pmb simultaneously so that left and right hydraulic pumps Pm are driven simultaneously.

Tilts of movable swash plates 65 of respective transaxles LA and RA are controlled independently of each other. Fluid delivery of each of hydraulic pumps Pm of respective transaxles LA and RA is controlled in amount and direction in correspondence to the tilt direction and angle of corresponding movable swash plate 65, and the fluid delivered from each hydraulic pump Pm is supplied to corresponding hydraulic motor M2 via main fluid passages 90 and 91 so as to drive hydraulic motor M2, thereby driving corresponding axle Lx or Rx.

In connection with the above-mentioned HST, each of transaxles LA and RA includes a fluid sump Rp, a charge pump 80, a charge relief valve 81, a check valve 82, a bypass valve 92, a charge check valve 83, and a charge check valve 85.

Charge check valve 83 provided with a neutral valve 84 is connected to main fluid passage 90. Charge check valve 85 provided with a neutral valve 86 is connected to main fluid passage 91.

Fluid delivered from charge pump 80 of each of transaxles LA and RA is supplied as hydraulic fluid to corresponding servo mechanism LB or RB attached to corresponding transaxle LA or RA, and is further supplied to the HST of the other transaxle LA or RA via corresponding servo mechanism LB or RB. In other words, the HST in each transaxle LA or RA is supplied with hydraulic fluid delivered from charge pump 80 in the other transaxle LA or RA. Therefore, fluid delivered from charge pump 80 is circulated to be sufficiently cooled before it is supplied to the HST, thereby reducing heat of the HST.

Functions of charge relief valve 81, charge check valves 83 and 85, neutral valves 84 and 86 and bypass valve 92 are the same as those of charge relief valve 26, check valves 271 and 272, neutral valve 283 and bypass valve 29.

Incidentally, in this embodiment, both charge check valves 83 and 85 are provided with respective neutral valves 84 and 86 bypassing respective charge check valves 83 and 85. Further, there is no relief valve corresponding to above-mentioned relief valves 281 and 282 for regulating pressure in a higher-pressurized main fluid passage. However, each of neutral valves 84 and 85 functions to discharge fluid from higher-pressurized main fluid passage 90 or 91 to lower-pressurized main fluid passage 90 or 91, thereby ensuring the function to regulating pressure in the higher-pressurized main fluid passage.

Check valve 82 is provided to supply hydraulic fluid from fluid sump Rb to hydraulically depressed (i.e., lower-pressurized) main fluid passage 90 or 91. When the prime mover of the vehicle is stationary so as to drive neither pump shaft Pma of hydraulic pump Pm nor charge pump 80, check valve 82 is opened to supply hydraulic fluid to hydraulically depressed main fluid passage 90 or 91.

Therefore, a vehicle parked on a slope is prevented from leaking hydraulic fluid from the closed fluid circuit of the HST. Accordingly, the vehicle is prevented from unexpectedly descending the slope because of the fluid leak causing reduction in quantity of hydraulic fluid resisting hydraulic motor M2.

Each of left and right servo mechanisms LB and RB is provided to control tilt direction and angle of movable swash plate 65 of hydraulic pump Pm in transaxle casing LAa or RAa of corresponding transaxle LA or RA.

In the aforesaid embodiment, servo unit 2 serves as a servo mechanism for hydraulic pump 1. Servo housing 20 of servo unit 2 incorporates both changeover valves 24 and 25 and hydraulic cylinder 21. On the contrary, in the present embodiment, each of servo mechanisms LB and RB includes a corresponding valve block LV or RV and hydraulic cylinder CR separated from valve block LV or RV.

Each of servo mechanisms LB and RB needs pipes interposed between corresponding valve block LV or RV and hydraulic cylinder Cr separated from valve block LV or RV. However, a thickness of each valve block LV or RV is advantageously reduced because of the separation of hydraulic cylinder Cr from valve block LV or RV. Each servo mechanism LB or RB can have a space between corresponding valve block LV or RV and hydraulic cylinder Cr so that various relevant or irrelevant members can be disposed in the space. Hydraulic cylinder Cr and each of valve blocks LV and RV can be located free from each other so as to enhance the freedom in layout of each servo mechanism LB or RB.

Each of servo mechanisms LB and RB is disposed forward or rearward from corresponding transaxle LA or RA. In this embodiment, servo mechanism LB and RB are disposed forward from left and right transaxles LA and RA.

For example, if a mower tractor having a mid-shipped mower unit is equipped with hydraulic transaxle system 100 for driving rear drive wheels of the mower tractor, servo mechanisms LB and RB disposed forward from transaxles LA and RA carrying respective left and right axles Lx and Rx are located immediately rearward from the mower unit. Therefore, transaxles LA and RA protectively cover servo mechanisms LB and RB including delicate instruments and exposed pipes.

Hereinafter, hydraulic transaxle system 100 will be described on the assumption that servo mechanisms LB and RB are disposed forward from transaxles LA and RA. Valve blocks LV and RV are fixed to front sides of lower portions of transaxle casings LAa and RAa of respective transaxles LA and RA. Hydraulic cylinders Cr are fixed to front sides of upper portions of respective transaxle casings LAa and RAa.

In this way, valve blocks LV and RV are mounted on the lower portions of respective transaxle casings LAa and RAa. On the other hand, hydraulic cylinders Cr separated from respective valve blocks LV and RV are mounted on the upper portions of respective transaxle casings LAa and RAa.

The vertical thickness of each of valve blocks LV and RV is reduced by separating hydraulic cylinder Cr therefrom, thereby reducing its lower expansion. Valve blocks LV and RV are disposed so that their bottom ends are as high as bottom ends of respective of transaxle casings LAa and RAa, thereby ensuring a required ground clearance of the vehicle.

Referring to FIG. 17, changeover valves 44 and 45 are fitted downward into each of valve blocks LV and RV, so that left and right proportional solenoids 44*a* and 45*a* are juxtaposed to extend upward from a top surface of each of valve blocks LV and RV.

Valve blocks LV and RV have respective sides facing (close to) each other. The sides of valve blocks LV and RV facing each other are referred to as their proximal sides. Sides of valve blocks LV and RV opposite (away from) each other are referred to as their distal sides. On this assumption, each of valve blocks LV and RV has changeover valve 44 at its distal side, and changeover valve 45 at its proximal side. Front portion of transaxle casings LAa and RAa are protectively disposed as fences adjacent to (immediately rearward from) proportional solenoids 44*a* and 45*a*.

Changeover valve 44 includes proportional solenoid 44*a*, a suction port 44*b*, a discharge port 44*c*, and a suction/discharge port 44*d*. Changeover valve 45 includes proportional solenoid 45*a*, a suction port 45*b*, a discharge port 45*c*, and a suction/discharge port 45*d*. Each of proportional solenoids 44*a* and 45*a* generates a driving force proportional to a control current value that is a value of control current applied thereto. One of changeover valves 44 and 45 (in this embodiment, changeover valve 44) has proportional solenoid 44*a* or 45*a* (in this embodiment, proportional solenoid 44*a*) excited for forward traveling of the vehicle, and the other of changeover valves 44 and 45 (in this embodiment, changeover valve 45) has proportional solenoid 44*a* or 45*a* (in this embodiment, proportional solenoid 45*a*) excited for backward traveling of the vehicle.

Each of changeover valves 44 and 45 is configured so that it is vibratorily switched between a supply position and a discharge position in correspondence to the value of control current applied thereto. For example, when changeover valve 44 is disposed at its supply position, suction port 44*b* is fluidly connected to suction/discharge port 44*d* so that fluid introduced into suction port 44*b* is supplied to a corresponding hydraulic fluid chamber in hydraulic cylinder Cr. On the other hand, when changeover valve 45 is disposed at its discharge position so as to fluidly connect suction/discharge port 45*d* to discharge port 45*c*, so that fluid introduced from another corresponding hydraulic fluid chamber in hydraulic cylinder Cr to suction/discharge port 45*d* is discharged to the outside of port block LV.

Such fluid supply and discharge are repeated so as to set a pressure in each of the hydraulic fluid chambers in hydraulic cylinder Cr. A controller (not shown) controls the control current values applied to respective proportional solenoids 44*a* and 45*a* in hydraulic transaxle system 100 in correspondence to an operational degree of a manipulator such as the aforesaid manipulator.

Figure 19:
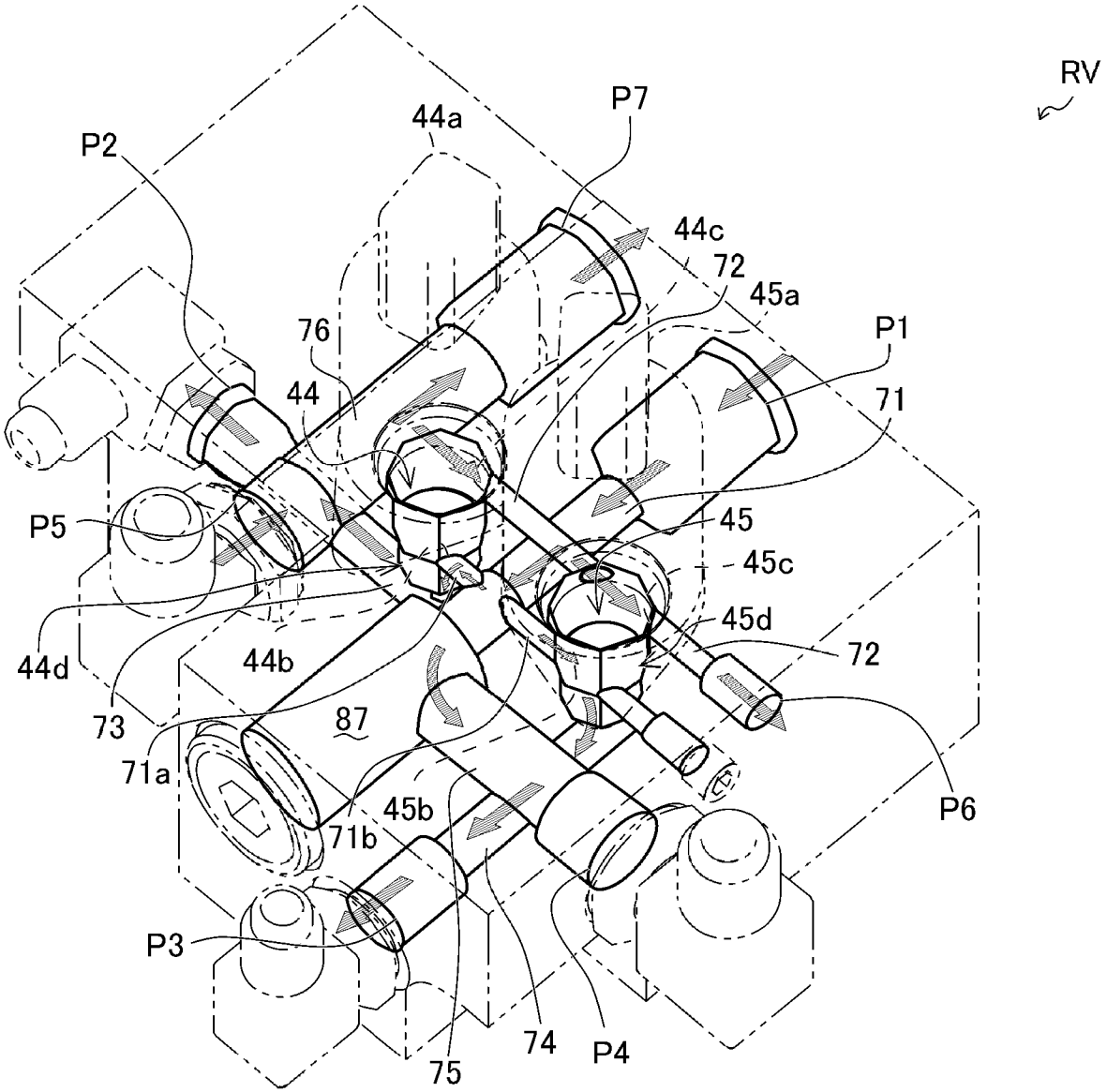
FIG. 19 is a transmissive perspective plan view of a fluid passage system inside a right valve block representative of valve blocks of right and left servomechanisms attached to the respective right and left transaxles in the hydraulic transaxle system shown in FIGS. 17 and 18.

Referring to FIG. 19, a transaxle outlet port P1 and a transaxle inlet port P7 are open at each of rear side surfaces of valve blocks LV and RV contacting respective transaxle casings LAa and RAa.

Referring to FIGS. 17 to 19, a first suction/discharge port P2, a second suction/discharge port P3, an outlet port P4, a return port P5, and a drain port P6 are open at each of outer side surfaces of respective valve blocks LV and RV. First suction/discharge port P2 is fluidly connected to suction/discharge port 44*d* of changeover valve 44. Second suction/discharge port P3 is fluidly connected to suction/discharge port 45*d* of changeover valve 45. Outlet port P4 is fluidly connected to a fluid-release port of servo relief valve 87. Return port P5 is fluidly connected to transaxle inlet port P7. Drain port P6 is fluidly connected to discharge ports 44*c* and 45*c* of respective changeover valves 44 and 45.

Outer side surfaces of valve blocks LV and RV facing (close to) each other in the lateral direction of hydraulic transaxle system 100 are referred to as proximal side surface of respective valve blocks LV and RV. Other outer side surfaces of valve blocks LV and RV opposite (away from) each other in the lateral direction of hydraulic transaxle system 100 are referred to as distal side surface of respective valve blocks LV and RV. On this assumption, each of valve blocks LV and RV is provided with outlet port P4 and drain port P6 at the proximal side surface thereof, with first suction/discharge port P2 at the distal side surface thereof, with second suction/discharge port P3 at a proximal front portion thereof, and with return port P5 at a distal front portion thereof.

Each hydraulic cylinder Cr is provided with a first port Cp1 at a distal front portion thereof, and with a second port Cp2 at a proximal front portion thereof. Hydraulic cylinder Cr is divided by a piston therein into a proximal hydraulic fluid chamber and a distal hydraulic fluid chamber. First port Cp1 is fluidly connected to the distal hydraulic fluid chamber. Second port Cp2 is fluidly connected to the proximal hydraulic fluid chamber.

Referring to FIG. 19, each of valve blocks LV and RV is assumed to be divided into a proximal half portion and a distal half portion by a lateral center portion thereof. On this assumption, changeover valves 44 and 45 are disposed in the proximal half portion of each valve block LV or RV. The proximal half portion of each valve block LX or RV is expanded at a front portion thereof forward from changeover valves 44 and 45 so as to incorporate a servo relief valve 87 extended in the fore-and-aft horizontal direction.

In other words, a front portion of each valve block LV or RV is formed with a step between a front end of the distal half portion and a front end of the proximal half portion projecting forward from the front end of the distal half portion.

A layout of fluid passages in representative right valve block RV will be described with reference to FIG. 19. Description of a layout of fluid passages in left valve block LV is omitted because left valve block LV has the same fluid passage structure as that of right valve block RV except that left and right valve blocks LV and RV are laterally symmetric.

Left and right juxtaposed changeover valves 44 and 45 are formed vertically downward from a top surface of valve block RV. Changeover valves 44 and 45 are formed with respective discharge ports 44*c* and 45*c* in upper portions thereof, with suction ports 44*b* and 45*b* in vertical intermediate portions thereof, and with suction/discharge ports 44*d* and 45*d* in lower end portions thereof.

Transaxle outlet port P1 open at the rear side surface of valve block RV and servo relief valve 87 installed in a front portion of valve block RV are disposed coaxially to each other, and are fluidly connected to each other via a fluid-suction fluid 71 extended in the fore-and-aft direction in valve block RV between left and right changeover valves 44 and 45.

A lateral horizontal fluid hole is bored in valve block RV between suction port 44*b* of distal (in FIG. 19, left) changeover valve 44 and suction port 45*b* of proximal (in FIG. 19, right) changeover valve 45 so as to cross fluid-suction passage 71 perpendicularly. A portion of the fluid hole extended from fluid-suction passage 71 to suction port 44*b* of distal changeover valve 44 is referred to as a first fluid-suction passage 71*a*. Another portion of the fluid hole extended from fluid-suction passage 71 to suction port 45*b* of proximal changeover valve 45 is referred to as a second fluid-suction passage 71*b*.

Another lateral horizontal fluid hole serving as a fluid-discharge passage 72 is bored in valve block RV distally (rightward) from drain port P6 open at the proximal (left) side surface of (right) valve block RV so as to pass discharge port 45*c* of proximal changeover valve 45 and so as to reach discharge port 44*c* of distal changeover valve 44.

The portion of fluid-discharge passage 72 between discharge ports 44*c* and 45*c* is passed above fore-and-aft fluid-suction passage 71 so as not to cross fluid-suction passage 71. Fluid-discharge passage 72 fluidly connects discharge ports 44*c* and 45*c* of changeover valves 44 and 45 to drain port P6.

A first fluid suction/discharge passage 73 is extended in valve block RV along the front side surface of the distal half portion of valve block RV from suction/discharge port 44*d* at the lower end of distal changeover valve 44 to first suction/discharge port P2 disposed at the distal (right) side surface of valve block RV.

A second fluid suction/discharge passage 74 is extended in valve block RV along the proximal (left) side surface of the proximal half portion of valve block RV from suction/discharge port 45*d* at the lower end of proximal changeover valve 45 to second suction/discharge port P3 disposed at the proximal (left) front surface of valve block RV.

A lateral horizontal fluid-release passage 75 is extended in the expanded proximal half portion of valve block RV from servo relief valve 87 to outlet port P4 disposed at the proximal side surface of valve block RV. Fluid-release passage 75 is passed above second fluid suction/discharge passage 74 so as not to cross second suction/discharge passage 74.

Return port P5 open at the front side surface of the distal half portion of valve block RV and transaxle inlet port P7 open at the rear side surface of valve block RV are disposed coaxially to each other, and are fluidly connected to each other via a fluid-return passage 76 extended in the fore-and-aft horizontal direction in valve block RV.

Fluid-return passage 76 is extended in an upper portion of valve block RV above first fluid suction/discharge passage 73 so as not to cross first fluid suction/discharge passage 73. Also, first-return passage 76 is passed distally outward (rightward) from distal changeover valve 44 extended vertically so as not to cross changeover valve 44.

A piping system relevant to left and right servo mechanisms LB and RB will be described with reference to FIGS. 17 and 18.

Each of servo mechanisms LB and RB is provided with fluid pipes 93 and 94 interposed between corresponding valve block VL or RV and hydraulic cylinder Cr disposed above corresponding valve block LV or RV. Fluid pipe 93 fluidly connects first suction/discharge port P2 to first port Cp1. Fluid pipe 94 fluidly connects second suction/discharge port P3 to second port Cp2. Due to these pipes 93 and 94, both the hydraulic fluid chambers in each hydraulic cylinder Cr are fluidly connected to respective suction/discharge ports 44*d* and 45*d* of changeover valves 44 and 45 of each valve block LV or RV.

Fluid pipes 96 and 97 are interposed between left and right valve blocks LV and RV. Fluid pipe 96 fluidly connects outlet port P4 of left valve block LV to return port P5 of right valve block RV. Fluid pipe 97 fluidly connects outlet port P4 of right valve block RV to return port P5 of left valve block LV. Due to these pipes 96 and 97, fluid circulates between valve blocks LV and RV.

Fluid pipes 95 are extended from drain ports P6 of respective valve blocks LV and RV and tank R2. Referring to FIG. 18, transaxle casings LAa and RAa are provided with respective outwardly open drain ports PLa and PRa fluidly connected to fluid sumps Rp therein. Fluid pipes 98 are extended from respective drain ports PLa and PRa to tank R2.

Charge pump 80 in each of transaxles LA and RA sucks fluid from fluid sump Rp in its transaxle casing LAa or RAa, and delivers fluid into valve blocks LV and RV via transaxle outlet port P1 and fluid-suction passage 71. Therefore, fluid delivered from charge pump 80 is introduced into each of valve blocks LV and RV, has a pressure regulated by corresponding servo relief valve 87, and flows into suction ports 44*b* and 45*b* of changeover valves 44 and 45 via first and second fluid-suction passages 71*a* and 71*b*.

When solenoid 44*a* of changeover valve 44 is excited, hydraulic fluid is supplied from suction/discharge port 44*d* to one hydraulic fluid chamber in hydraulic cylinder Cr via first fluid suction/discharge passage 73, first suction/discharge port P2, fluid pipe 93, and first port Cp1. When solenoid 44*a* of changeover valve 44 is unexcited, hydraulic fluid is discharged from the one hydraulic fluid chamber in hydraulic cylinder Cr to tank R2 via first port Cp1, fluid pipe 93, first suction/discharge port P2, first fluid suction/discharge passage 73, suction/discharge port 44*d*, discharge port 44*c*, fluid-discharge passage 72, drain port P6 and fluid pipe 95.

When solenoid 45*a* of changeover valve 45 is excited, hydraulic fluid is supplied from suction/discharge port 45*d* to the other hydraulic fluid chamber in hydraulic cylinder Cr via second fluid suction/discharge passage 74, second suction/discharge port P3, fluid pipe 94, and second port Cp2. When solenoid 45*a* of changeover valve 45 is unexcited, hydraulic fluid is discharged from the other hydraulic fluid chamber in hydraulic cylinder Cr to tank R2 via second port Cp2, fluid pipe 94, second suction/discharge port P3, second fluid suction/discharge passage 74, suction/discharge port 45*d*, discharge port 45*c*, fluid-discharge passage 72, drain port P6 and fluid pipe 95.

Excessive fluid released from servo relief valve 87 of left valve block LV is introduced into right transaxle RA via fluid-release passage 75 and outlet port P4 of left valve block LV, fluid pipe 96 interposed between left and right valve blocks LV and RV, and return port P5, fluid-return passage 76 and transaxle inlet port P7 of right valve block RV. In right transaxle RA, the excessive fluid has a pressure regulated by charge relief valve 81, and then is supplied to main fluid passages 90 and 91 of the HST of right transaxle RA via charge check valves 83 or 85.

On the other hand, excessive fluid released from servo relief valve 87 of right valve block RV is introduced into left transaxle LA via fluid-release passage 75 and outlet port P4 of right valve block RV, fluid pipe 97 interposed between left and right valve blocks LV and RV, and return port P5, fluid-return passage 76 and transaxle inlet port P7 of left valve block LV. In left transaxle LA, the excessive fluid has a pressure regulated by charge relief valve 81, and then is supplied to main fluid passages 90 and 91 of the HST of left transaxle LA via charge check valves 83 or 85.

In this way, each transaxle LA or RA is provided with a hydraulic series circuit fluidly connecting the fluid-release passage from servo relief valve 87 of servo mechanism LB or RB attached thereto to charge relief valve 81 in the other transaxle LA or RA, including each fluid pipe 96 or 97.

Incidentally, each of transaxles LA and RA has excessive fluid released from charge relief valve 81 therein and discharged to fluid sump Rp in its own transaxle casing LAa or RAa. Fluid sumps Rp are fluidly connected to tank R2 via respective drain ports PLa and PRa and fluid pipes 98. Therefore, when the HST of each of transaxles LA and RA is activated heating fluid sump Rp therein so as to expand fluid sump Rp in volume, the volumetric expansion of fluid sump Rb is absorbed to tank R2 so as to regulate the volume of fluid sump Rp.

It is further understood by those skilled in the art that the foregoing description is given to preferred embodiments of the disclosed apparatus and that various changes and modifications may be made in the invention without departing from the scope thereof defined by the following claims.

What is claimed is:

1. A hydraulic pump, comprising:

a drive shaft that receives power from a power source;

a housing journaling the drive shaft;

a port block assembled with the housing;

a cylinder block slidably and rotatably attached to the port block and disposed in the housing;

a plurality of plungers fitted into respective cylinders formed in the cylinder block so as to reciprocally slide parallel to the drive shaft; and a movable swash plate rotatably supported by the housing and abuts against the plurality of plungers, wherein the housing is configured to selectively receive a servo unit for adjusting a tilt direction and a tilt angle of the movable swash plate, such that the servo unit is configured to selectively attach to and selectively detach from the housing, wherein the port block includes a pair of externally open ports which are configured to be fluidly connected via respective external pipes to a hydraulic motor disposed separately from the hydraulic pump, wherein the port block includes a pair of main fluid passages connecting the respective externally open ports to the cylinders in the cylinder block, wherein the port block includes a fluid-charge passage for supplying hydraulic fluid to the pair of main fluid passages, wherein the port block has a plane surface to which the cylinder block is attached, wherein the plane surface is perpendicular to the drive shaft, wherein the pair of main fluid passages include parallel portions, which are parallel to each other and to the plane surface, wherein a pair of charge check valves are disposed on the parallel portions of the pair of main fluid passages, respectively, wherein the port block is provided therethrough between one side surface and another side surface thereof opposite each other with the fluid-charge passage fluidly connected to the pair of charge check valves, wherein an open end of the fluid-charge passage at the one side surface of the port block serves as a port for receiving hydraulic fluid from an outside of the hydraulic pump, and wherein another open end of the fluid-charge passage at the other side surface of the port block serves as a servo port for supplying hydraulic fluid to the servo unit attached to the housing.

2. The hydraulic pump according to claim 1, wherein the port block is provided with a charge relief valve for regulating a hydraulic pressure in the fluid-charge passage, and wherein the charge relief valve is extended from the port block to an inside of the housing.

3. The hydraulic pump according to claim 2, wherein the charge relief valve and the fluid-charge passage are disposed in a portion of the port block between the pair of charge check valves, and wherein the charge relief valve is extended parallel to the drive shaft.

4. The hydraulic pump according to claim 1, further comprising:

a pair of supporters by which the movable swash plate is tiltably supported at respective opposite side portions thereof; and a sensor for detecting a tilt angle of the movable swash plate, wherein the servo unit is fixed to one of the supporters, and wherein the sensor is fixed to the other of the supporters.

5. The hydraulic pump according to claim 1, wherein the hydraulic pump is provided with at least one external pump driven by the drive shaft, and is configured so that fluid delivered from the at least one external pump is supplied to the servo unit, and wherein a filter is assembled with the hydraulic pump so as to filter the fluid delivered from the at least one external pump before the fluid enters the servo unit.

6. A hydraulic pump, comprising:

a drive shaft that receives power from a power source;

a housing journaling the drive shaft;

a port block assembled with the housing;

a cylinder block slidably and rotatably attached to the port block and disposed in the housing;

a plurality of plungers fitted into respective cylinders formed in the cylinder block so as to reciprocally slide parallel to the drive shaft; and a movable swash plate rotatably supported by the housing and abuts against the plurality of plungers, wherein the housing is configured so that a servo unit for adjusting a tilt direction and a tilt angle of the movable swash plate is detachably attachable to the housing, wherein the port block includes a pair of externally open ports which are configured to be fluidly connected via respective external pipes to a hydraulic motor disposed separately from the hydraulic pump, wherein the port block includes a pair of main fluid passages connecting the respective externally open ports to the cylinders in the cylinder block, wherein the port block includes a fluid-charge passage for supplying hydraulic fluid to the pair of main fluid passages, wherein the port block is provided with a charge relief valve for regulating a hydraulic pressure in the fluid-charge passage, wherein the charge relief valve is extended from the port block to an inside of the housing, wherein the port block has a plane surface to which the cylinder block is attached, wherein the plane surface is perpendicular to the drive shaft, wherein the pair of main fluid passages include parallel portions, which are parallel to each other and to the plane surface, wherein a pair of charge check valves are disposed on the parallel portions of the pair of main fluid passages, respectively, wherein the charge relief valve and the fluid-charge passage are disposed in a portion of the port block between the pair of charge check valves, and wherein the charge relief valve is extended parallel to the drive shaft.

7. The hydraulic pump according to claim 6, wherein the port block is provided therethrough between one side surface and another side surface thereof opposite each other with the fluid-charge passage crossing the pair of charge check valves, wherein an open end of the fluid-charge passage at the one side surface of the port block serves as a gauge port for receiving hydraulic fluid from an outside of the hydraulic pump, and wherein another open end of the fluid-charge passage at the other side surface of the port block serves as a servo port for supplying hydraulic fluid to the servo unit attached to the housing.

8. A hydraulic pump system, comprising:

a hydraulic pump comprising:

a drive shaft that receives power from a power source;

a housing journaling the drive shaft;

a port block assembled with the housing;

a cylinder block slidably and rotatably attached to the port block and disposed in the housing;

a plurality of plungers fitted into respective cylinders formed in the cylinder block so as to reciprocally slide parallel to the drive shaft; and a movable swash plate rotatably supported by the housing and abuts against the plurality of plungers; and a servo unit for adjusting a tilt direction and a tilt angle of the movable swash plate, wherein the housing is configured to selectively receive the servo unit, such that the servo unit is configured to selectively attach to and selectively detach from the housing, wherein the port block includes a pair of externally open ports which are configured to be fluidly connected via respective external pipes to a hydraulic motor disposed separately from the hydraulic pump, wherein the port block includes a pair of main fluid passages connecting the respective externally open ports to the cylinders in the cylinder block, wherein the port block includes a fluid-charge passage for supplying hydraulic fluid to the pair of main fluid passages, wherein the port block is provided with a charge relief valve for regulating a hydraulic pressure in the fluid-charge passage, wherein the charge relief valve is extended from the port block to an inside of the housing wherein a pair of charge check valves are disposed on parallel portions of the pair of main fluid passages, wherein the charge relief valve and the fluid-charge passage are disposed in a portion of the port block between the pair of charge check valves, and wherein the charge relief valve is extended parallel to the drive shaft.

9. The hydraulic pump system according to claim 8, further comprising:

a pair of supporters by which the movable swash plate is tiltably supported at respective opposite side portions thereof; and a sensor for detecting a tilt angle of the movable swash plate, wherein the servo unit is fixed to one of the supporters, and wherein the sensor is fixed to the other of the supporters.

10. The hydraulic pump system according to claim 8, wherein the hydraulic pump is provided with at least one external pump driven by the drive shaft, and is configured so that fluid delivered from the at least one external pump is supplied to the servo unit, and wherein a filter is assembled with the hydraulic pump so as to filter the fluid delivered from the at least one external pump before the fluid enters the servo unit.

11. The hydraulic pump system according to claim 8, wherein the servo unit is configured to be exchanged for a non-servo actuator and the non-servo actuator is configured to attach to and detach from the housing.

* * * * *